US006437550B2

(12) United States Patent
Andoh et al.

(10) Patent No.: US 6,437,550 B2
(45) Date of Patent: Aug. 20, 2002

(54) VOLTAGE GENERATING CIRCUIT AND REFERENCE VOLTAGE SOURCE CIRCUIT EMPLOYING FIELD EFFECT TRANSISTORS

(75) Inventors: Shunsuke Andoh, Chiba; Hirofumi Watanabe, Hyogo, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/748,190

(22) Filed: Dec. 27, 2000

(30) Foreign Application Priority Data

Dec. 28, 1999 (JP) ..... 11-372432
Jan. 24, 2000 (JP) ..... 2000-014330
Dec. 19, 2000 (JP) ..... 2000-386059

(51) Int. Cl.[7] ..... G05F 3/16
(52) U.S. Cl. ..... 323/315; 323/313; 327/541
(58) Field of Search ..... 323/315, 312, 323/313, 314, 316; 307/296.1, 251, 585; 327/540, 541, 543

(56) References Cited

U.S. PATENT DOCUMENTS 3,639,813 A * 2/1972 Kamoshida et al. ..... 257/260
4,327,320 A 4/1982 Oguey et al.
4,417,263 A 11/1983 Matsuura
5,159,260 A * 10/1992 Yoh et al. ..... 323/313
5,311,036 A * 5/1994 Nishino et al. ..... 257/30
5,610,550 A * 3/1997 Furutani ..... 327/543

FOREIGN PATENT DOCUMENTS

JP 4-65546 10/1992

OTHER PUBLICATIONS

Tsividis et al.; "A CMOS voltage Reference"; IEEE Journal of Solid–State Circuits, vol. SC–13, No. 6, Dec. 1978, pp. 774–778. No Date.

Vittoz et al.; "CMOS Analog Integrated Circuits Based on Week Inversion Operation"; IEEE Journal of Solid–State Circuits, vol. SC–12, No. 3, Jun. 1997, pp. 224–231.

Vittoz et al.; "A Low–Voltage CMOS Bandgap Reference"; IEEE Journal of Solid–State Circuits, vol. SC–14, No. 3, Jun. 1979, pp. 573–577. No. Date.

Oguey et al.; "MOS Voltage Reference Based on Polysilicon Gate Work Function Difference"; IEEE Journal of Solid–State Circuits, vol. SC–15, No. 3, Jun. 1980, pp. 265–269.

Blauschild et al.; "A New NMOS Temterature–Stable Voltage Reference"; IEEE Journal of Solid–State Circuits, vol. SC–13, No. 6, Dec. 1978, pp. 767–773.

* cited by examiner

*Primary Examiner*—Rajnikant B. Patel
(74) *Attorney, Agent, or Firm*—Dickstein Shapiro Morin & Oshinsky LLP

(57) ABSTRACT

A voltage generating circuit includes a plurality of field effect transistors at least partially having gates same in conductivity type but different in impurity concentration. The gates are different in impurity concentration by not less than one digit.

44 Claims, 17 Drawing Sheets

| | | Typ(Typ) | Max(Min) | Min(Max) |
|---|---|---|---|---|
| Ng1 | [1/cm ^3] | 2e+16 | 2.2e+16 | 1.8e+16 |
| Ng2 | [1/cm ^3] | 1e+20 | 9e+19 | 1.1e+20 |
| | | | | |
| | | | | |
| ln(Ng2/Ng1) | [] | 8.52 | 8.32 | 8.72 |
| VPTAT(T=300K) | [V] | 0.221 | 0.216 | 0.227 |
| dVPTAT/dT | [V/T] | 7.38e-4 | 7.21e-4 | 7.56e-4 |

| | NH | NL | PL | PH |
|---|---|---|---|---|
| N-CHANNEL MOS TRANSISTOR | -0.5V | -0.4V | 0.5V | 0.6V |
| P-CHANNEL MOS TRANSISTOR | -0.6V | -0.5V | 0.4V | 0.5V |

VOLTAGE GENERATING CIRCUIT AND REFERENCE VOLTAGE SOURCE CIRCUIT EMPLOYING FIELD EFFECT TRANSISTORS

BACKGROUND OF THE INVENTION

1. Field of the Invention

The present invention generally relates to a voltage generating circuit which can be used in a reference voltage generating circuit, a temperature compensating circuit of a voltage comparator, a current source including a combination of a temperature sensor and a resistor having a linear temperature characteristic, and so forth. In particular, the present invention relates to a voltage generating circuit employing field effect transistors (which will be described in examples in which MOS-type field effect transistors are employed) generating a voltage proportion to the absolute temperature (PTAT: Proportional-To-Absolute-Temperature).

Further, the present invention relates to a reference voltage source circuit used in an analog circuit or the like, in particular, a reference voltage source circuit employing field effect transistors (which will be described in examples in which MOS-type field effect transistors are employed) which operates stably even at a temperature not lower than 80° C., generates a voltage proportional to the absolute temperature (PTAT) and thus has a desired temperature characteristic.

2. Description of the Related Art

A PTAT circuit is known as a voltage generating circuit employing bipolar transistors. A PTAT circuit which achieves this art by utilizing a weak inversion range of a MOS (or CMOS) transistor has been also proposed. Further, as a reference voltage source, a reference voltage source such that a voltage source having a positive temperature coefficient is produced by causing a field effect transistor to operate in a weak inversion range, and, using it, a reference voltage source having a small variation in characteristic with respect to temperature is achieved is also known. These arts will now be described.

For example, E. Vittoz and J. Fellrath, "CMOS Analog Integrated Circuits Based on Weak Inversion Operation", Vol. SC-12, No. 3, pages 224–231, June, 1997 (reference B) discloses a PTAT (Proportional-To-Absolute-Temperature) employing CMOS transistors. Thereby, a drain current $I_D$ in a weak inversion range is given by the following equation:

$$I_D = SI_{DO}\exp(VG/nU_T)\{\exp(-VS/U_T)-\exp(-VD/U_T)\}$$

There, VG, VS and VD denote a voltage between a substrate and a gate, a voltage between the substrate and a source, and a voltage between the substrate and a drain, respectively; S denotes a ratio ($W_{eff}/L_{eff}$) of effective channel width W and channel length L; $I_{DO}$ denotes a characteristic current determined by process technology; n denotes a slope factor (rising characteristic in a weak inversion range); and $U_T$ denotes kT/q. There, k denotes the Boltzmann's constant; T denotes the absolute temperature; and q denotes the charge of carrier (electron).

Further, Tsividis and Ulmer, "A CMOS Voltage Reference", IEEE Journal of Solid-State Circuits, Vol. SC-13, No. 6, pages 774–778, December, 1978 (reference A) discloses, as shown in FIG. 1 of the present application, currents $I_1$ and $I_2$ are caused to flow through source-connected n-type-channel transistors T1 and T2, respectively, and, as a difference between gate voltages (V1−V2), a VPTAT is obtained as follows (see FIG. 4 of the reference A):

$$\text{VPTAT}=V1-V2=nU_T\ln\{(S_2I_1)/(S_1I_2)\}$$

Further, in FIG. 1, where the voltage drop between base and emitter of the bipolar transistor is referred to as Vbe, and the output is referred to as Vo, $$Vbe+V1=V2+Vo$$

Accordingly, the output Vo is obtained as follows:

$$Vo=Vbe+(V1-V2)=Vbe+\text{VPTAT}$$

The base-emitter voltage Vbe of the bipolar transistor at the first term has a negative temperature coefficient with respect to the absolute temperature. Further, VPTAT at the second term has a positive temperature coefficient with respect to the absolute temperature. Accordingly, the output Vo obtained from addition thereof has a flat temperature characteristic.

Further, E. Vittoz and O. Neyroud, "A low-voltage CMOS bandgap reference", IEEE Journal of Solid-State Circuits, Vol. SC-14, No. 3, pages 573–577, June, 1979 (reference C) discloses, as shown in FIG. 2 of the present application, the same current I is caused to flow through gate-connected n-type-channel MOS transistors Ta and Tb, and, as a difference in source voltages therebetween, Vo is obtained as follows (see FIG. 7 of the reference C):

$$Vo=\text{VPTAT}=U_T\ln(1+Sb/Sa)$$

The VPTAT output in each of the above-mentioned references A and C is also proportional to $U_T$−kT/q.

Further, Oguey et al., "MOS Voltage Reference Based on Polysilicon Gate Work Function Difference", IEEE Journal of Solid-State Circuits, Vol. SC-15, No. 3, June, 1980 (reference D) discloses, as shown in FIG. 3 of the present application, a transistor T1 having a p+polysilicon gate and a transistor T2 having n+polysilicon gate are used as input transistors of a differential amplifier, each of these transistors is biased into a weak inversion range, a difference between the gate voltages VR=VG1−VG2=ΔVG+$U_T$ln ($I_{D1}S_2/I_{D2}S_1$), the bandgap of the silicon ΔVG and VPTAT: $U_T\ln(I_{D1}S_2/I_{D2}S_1)$ are obtained.

Further, because $$\Delta VG=\Delta VG_o-\alpha_m T$$

it is assumed that $\alpha_m T=U_T\ln(I_{D1}S_2/I_{D2}S_1)$, and a voltage VR which does not depend on the temperature is obtained as follows (see FIG. 9 of the reference D):

$$VR=\Delta V_{GO}=1.20(V)$$

Thus, in the related arts, VPTAT is achieved by utilizing a weak inversion range of a MOS transistor instead of a bipolar transistor. However, when the weak inversion range is utilized, the following problems may occur:

a) Problem that, in order to cause a gate of a MOS transistor to enter a weak inversion range, a minute-current biasing circuit for weak inversion is needed:

According to the above-mentioned reference B (see the equation (12) of the reference), a drain current should satisfy the following condition in order to keep the MOS transistor in the weak inversion range:

$$I \leqq \{(n-1)/e^2\}S\mu C_{ox}U_T^2$$

There, n denotes a slope factor, S denotes the ratio ($W_{eff}/L_{eff}$) of effective channel width W and channel length L, $\mu$ denotes the mobility of carriers in channel, and $C_{ox}$ denotes the capacitance of the oxide film per unit area.

Specifically, as disclosed in U.S. Pat. No. 4,327,320, April, 1982, "Reference Voltage Source", Oguey (reference E), when n=1.7, S=1, $\mu$=750 ($cm^2/Vs$), $C_{ox}$=45 ($nF/cm^2$), and UT=26 (mV), the drain current at the room temperature should be a minute one not larger than 2 nA.

b) Problem due to Influence of Parasitic Diode:

However, when operation is made in a condition of a minute drain current not larger than 2 nA as mentioned above, it is easy to be affected by a leakage current due to a parasitic diode between the drain and substrate. For example, in the above-mentioned reference D, page 268, it is disclosed that, at a temperature not lower than 80° C., a problematic shift due to a leakage current occurs.

c) Problem that a current biasing circuit is needed for correcting a temperature characteristic of conductivity:

As disclosed U.S. Pat. No. 4,417,263, Y. Matsuura, November, 1983 (corresponding to Japanese Patent Publication No. 4-65546, reference G), by using a difference in threshold voltage between a depletion-type transistor and an enhancement-type transistor produced to have different substrate concentrations and/or channel dopings, and making conductivity thereof to be approximately equal, a reference voltage is obtained. However, a pair of MOS transistors, produced to have different substrate concentrations and/or channel dopings, have different conductivities and/or different temperature characteristics thereof. Accordingly, as disclosed by R. A. Blauschild et al., "A New NMOS Temperature-Stable Voltage Reference", Vol. SC-13, No. 6, pages 767–773, December, 1978 (reference F), a current biasing circuit for correcting the temperature characteristic of conductivity is needed.

SUMMARY OF THE INVENTION

An object of the present invention is to solve the above-mentioned problems, and to achieve a voltage generating circuit employing field effect transistors which operate stably at a high temperature not lower than 80° C. and can also be used in a strong inversion range.

Another object of the present invention is to provide a reference voltage source circuit employing field effect transistors having a desired temperature characteristic without using a minute current biasing circuit or a current biasing circuit for correcting a temperature characteristic of conductivity.

A voltage generating circuit according to the present invention comprises a plurality of field effect transistors at least partially having gates same in conductivity type but different in impurity concentration (see FIGS. 6 through 16).

The gates may be different in impurity concentration by not less than one digit.

The plurality of field effect transistors may comprise first and second field effect transistors (M1 and M2) having gates same in conductivity type but different in impurity concentration; and the gates of the first and second field effect transistors (M1, M2) may be connected, and the difference in source voltage between the first and second field effect transistors may be output (see FIGS. 6 and 7).

The plurality of field effect transistors may comprise first and second field effect transistors (M1 and M2) having gates same in conductivity type but different in impurity concentration; and the sources of the first and second field effect transistors may be connected, and the difference in gate voltage between the first and second field effect transistors may be output (see FIGS. 8 through 11).

The plurality of field effect transistors may comprise first and second field effect transistors (M1 and M2) having gates same in conductivity type but different in impurity concentration; and the voltage between the gate and source of any one (M2) of the first and second field effect transistors is made to be 0 volts, and, also, the voltage between the gate and source of the other one (M1) of the first and second field effect transistors may be output (see FIGS. 8 through 11).

Thereby, it is possible to provide voltage generating circuits employing field effect transistors having various circuit configurations which operate stably at a high temperature not lower than 80° C. and can be used not only in weak inversion but also in strong inversion.

The second field effect transistor (M2) may be an n-type-channel field effect transistor of depletion type, having the high-concentration n-type gate and having the gate and source thereof connected;

the first field effect transistor (M1) may be an n-type-channel field effect transistor (of depletion type) having a low-concentration n-type gate and having the drain thereof connected with the source of the second field effect transistor;

a third n-type-channel field effect transistor (M3) and a resistor (R) connected in series may be further provided;

a source-follower circuit is provided for applying the gate electric potential of the first field effect transistor by connecting the gate of the first field effect transistor to the connection point between the third field effect transistor and resistor; and the gate electric potential of the first field effect transistor may be output from that connection point (see FIG. 12A).

The second field effect transistor (M2) may be an n-type-channel field effect transistor of a depletion type, having a high-concentration n-type gate and having the gate and source thereof connected;

the first field effect transistor (M1) may be an n-type-channel field effect transistor (of depletion type) having a low-concentration n-type gate and having the drain thereof connected with the source of the second field effect transistor;

a third n-type-channel field effect transistor (M3), a first resistor (R1) and a second resistor (R2) connected in series may be further provided;

a source-follower circuit may be provided for applying the gate electric potential of the first field effect transistor by connecting the gate of the first field effect transistor to the connection point between the third field effect transistor and first resistor; and the electric potential at the connection point between the first and second resistors may be output (see FIG. 13A).

The second field effect transistor (M2) may be an n-type-channel field effect transistor of a depletion type, having a high-concentration n-type gate and having the gate and source thereof connected;

the first field effect transistor (M1) may be an n-type-channel field effect transistor (of depletion type) having a low-concentration n-type gate and having the drain thereof connected with the source of the second field effect transistor;

a third n-type-channel field effect transistor (M3), a first resistor (R1) and a second resistor (R2) connected in series may be further provided;

a source-follower circuit may be provided for applying the gate electric potential of the first field effect transistor by connecting the gate of the first field effect transistor to the connection point between the first and second resistors; and the electric potential at the connection point between the third field effect transistor and first resistor may be output (see FIG. 14A).

Thereby, by incorporating a resistor(s) in the voltage generating circuit, it is possible to correct VPTAT for variation in impurity concentrations.

The voltage generating circuit may further comprise a resistor trimming part by which the resistances of the first and second resistors (R1 and R2) are adjusted through laser trimming or the like after diffusion and deposition process in a manufacturing stage.

The first field effect transistor (M1) and second field effect transistor (M2) may be changed into p-type-channel field effect transistors (see FIGS. 12B, 13B and 14B).

Further, it is also possible that the above-described configuration of FIG. 12A is modified as follows: a current-mirror circuit consisting of p-type-channel MOS transistors (M6 and M7) is added in a current path of a current flowing through the resistor (R) connected between the gate and source of the MOS transistor (M1) having the low-concentration (Ng1) n-type polysilicon gate shown in FIG. 12A, and the output voltage VPTAT is obtained from the source of the p-type-channel MOS transistor (M7) (see FIG. 15).

Furthermore, it is also possible to make a configuration such as to include the source-connected MOS transistor (M1) having the low-concentration (Ng1) n-type polysilicon gate and the MOS transistor (M2) having the high-concentration (Ng2) n-type polysilicon gate connected in parallel between two power supply lines VCC and GND, the electric potentials of the drains of the MOS transistor (M1) and MOS transistor (M2) are input to a differential amplifier (A1), the output of the differential amplifier (A1) is fed back to the gate of the MOS transistor (M2) via a resistor (R2), and a resistor (R1) is provided between the power supply line VCC and the gate of the MOS transistor (M2) (see FIG. 16).

Thereby, it is possible to provide voltage generating circuits employing field effect transistors of conductivity type different from the above-mentioned configurations.

A reference voltage source circuit according to the present invention comprises:

a first voltage source comprising a plurality of field effect transistors circuit at least partly having semiconductor gates same in conductivity type but different in impurity concentration and having a positive temperature coefficient; and a second voltage source circuit comprising a plurality of field effect transistors at least partly having semiconductor gates different in conductivity type and having a negative temperature coefficient (see FIGS. 18 through 28).

The first and second voltage source circuits may comprise a first, second and third field effect transistors (M1, M2 and M3) connected in series and at least partially having semiconductor gates different in conductivity type or impurity concentration (see FIGS. 18 and 19).

The first field effect transistor (M1) may comprise a depletion-type n-type-channel field effect transistor having a high-concentration n-type gate and having the gate and source thereof connected;

the second field effect transistor (M2) may comprise an n-type-channel field effect transistor (of depletion type) having a low-concentration n-type gate;

the third field effect transistor (M3) may comprise an enhancement-type n-type-channel field effect transistor having a p-type gate and having the gate and drain thereof connected;

a source-follower circuit is provided for applying the gate electric potential of the second field effect transistor; and the gate voltage of the second field effect transistor is output as a reference voltage (see FIG. 18)

The first field effect transistor (M1) may comprise an enhancement-type p-type-channel field effect transistor having an n-type gate and having the gate and drain thereof connected;

the second field effect transistor (M2) may comprise a p-type-channel field effect transistor (of depletion type) having a low-concentration p-type gate;

the third field effect transistor (M3) may comprise a depletion-type p-type-channel field effect transistor having a high-concentration p-type gate and having the gate and source thereof connected;

a source-follower circuit is provided for applying the gate electric potential of the second field effect transistor; and the gate voltage of the second field effect transistor is output as a reference voltage (see FIG. 19).

The first and second voltage source circuits may comprise first, second, third and fourth field effect transistors (M1, M2, M3 and M4) at least partially having semiconductor gates different in conductivity type or impurity concentration (see FIGS. 20 through 25).

The first field effect transistor (M1) may comprise a depletion-type n-type-channel field effect transistor having an n-type gate and having the gate and source thereof connected;

the second field effect transistor (M2) may comprise an n-type-channel field effect transistor having a p-type gate;

the first and second field effect transistors are connected in series;

a source-follower circuit is provided for applying the gate electric potential of the second field effect transistor;

the third field effect transistor (M3) may comprise an n-type-channel field effect transistor having a high-concentration n-type gate and having the gate electric potential thereof applied by the source-follower circuit;

the fourth field effect transistor (M4) may comprise an n-type-channel field effect transistor having a low-concentration n-type gate;

a differential amplifier is configured to have the third and fourth field effect transistors as input transistors thereof; and the gate electric potential of the fourth field effect transistor is output as a reference voltage (see FIG. 20).

The first field effect transistor (M1) may comprise a p-type-channel field effect transistor having an n-type gate;

the second field effect transistor (M2) may comprise a depletion-type p-type-channel field effect transistor having a p-type gate and having the gate and source thereof connected;

the first and second field effect transistors are connected in series;

a source-follower circuit is provided for applying the gate electric potential of the second field effect transistor;

the third field effect transistor (M3) may comprise an n-type-channel field effect transistor having a high-concentration n-type gate and having the gate electric potential thereof applied by the source-follower circuit;

the fourth field effect transistor (M4) may comprise an n-type-channel field effect transistor having a low-concentration n-type gate;

a differential amplifier is configured to have the third and fourth field effect transistors as input transistors thereof; and the gate electric potential of the fourth field effect transistor is output as a reference voltage (see FIG. 21).

The first field effect transistor (M1) may comprise a depletion-type n-type-channel field effect transistor having an n-type gate and having the gate and source thereof connected;

the second field effect transistor (M2) may comprise a n-type-channel field effect transistor having a p-type gate;

the first and second field effect transistors are connected in series;

a source-follower circuit is provided for applying the gate electric potential of the second field effect transistor;

the third field effect transistor (M3) may comprise an n-type-channel field effect transistor (of depletion type) having the high-concentration n-type gate and having the gate electric potential thereof applied by the source-follower circuit;

the fourth field effect transistor (M4) may comprise an n-type-channel field effect transistor (of depletion type) having a low-concentration n-type gate and having the gate and source thereof made to be at a ground electric potential (GND);

the third and fourth field effect transistors are connected in series; and a reference voltage is output from the connection point between the third and fourth field effect transistors (see FIG. 22).

The first field effect transistor (M1) may comprise a p-type-channel field effect transistor having an n-type gate;

the second field effect transistor (M2) may comprise a depletion-type p-type-channel field effect transistor having a p-type gate and having the gate and source thereof connected;

the first and second field effect transistors are connected in series;

a source-follower circuit is provided for applying the gate electric potential of the first field effect transistor;

the third field effect transistor (M3) may comprise a p-type-channel field effect transistor having a low-concentration n-type gate and having the gate electric potential thereof applied by the source-follower circuit;

the fourth field effect transistor (M4) may comprise a p-type-channel field effect transistor having a high-concentration n-type gate and having the gate and drain thereof connected;

the third and fourth field effect transistors are connected in series; and a reference voltage is output from the connection point between the third and fourth field effect transistors (see FIG. 23).

The first field effect transistor (M1) may comprise a depletion-type n-type-channel field effect transistor having an n-type gate and having the gate and source thereof connected;

the second field effect transistor (M2) may comprise an n-type-channel field effect transistor having a p-type gate;

the first and second field effect transistors are connected in series;

a source-follower circuit is provided for applying the gate electric potential of the second field effect transistor;

the third field effect transistor (M3) may comprise a depletion-type p-type-channel field effect transistor having a high-concentration p-type gate and having the gate and source thereof connected;

the fourth field effect transistor (M4) may comprise a depletion-type p-type-channel field effect transistor having a low-concentration p-type gate and having the gate electric potential thereof applied by the source-follower circuit;

the third and fourth field effect transistors are connected in series; and a reference voltage is output from the connection point between the third and fourth field effect transistors (see FIG. 24).

The first field effect transistor (M1) may comprise a p-type-channel field effect transistor having an n-type gate;

the second field effect transistor (M2) may comprise a depletion-type p-type-channel field effect transistor having a p-type gate and having the gate and source thereof connected;

the first and second field effect transistors are connected in series;

a source-follower circuit is provided for applying the gate electric potential of the first field effect transistor;

the third field effect transistor (M3) may comprise a depletion-type n-type-channel field effect transistor having a high-concentration n-type gate and having the gate electric potential thereof applied by the source-follower circuit;

the fourth field effect transistor (M4) may comprise a depletion-type n-type-channel field effect transistor having a low-concentration n-type gate and having the gate and source thereof connected;

the third and fourth field effect transistors are connected in series; and a reference voltage is output from the connection point between the third and fourth field effect transistors (FIG. 25).

At least any one of the first and second voltage source circuits is employed a plurality of times (see FIGS. 26 and 27).

The second voltage source circuit may comprise a first field effect transistor (M1) comprising a depletion-type n-type-channel field effect transistor having an n-type gate and having the gate and source thereof connected, and a second field effect transistor (M2) comprising an enhancement-type n-type-channel field effect transistor having a p-type gate and having the gate and drain thereof connected, the first and second field effect transistors being connected in series;

a first one of the first voltage source circuit may comprise a third field effect transistor (M3) comprising an depletion-type n-type-channel field effect transistor having a high-concentration n-type gate and having the gate electric potential thereof applied by the drain voltage of the second field effect transistor and a fourth field effect transistor (M4) comprising a depletion-type n-type-channel field effect transistor having a low-concentration n-type gate and having the gate and source thereof made to be a ground electric potential (GND), the third and fourth field effect transistors being connected in series;

a second one of the first voltage source circuit may comprise a fifth field effect transistor (M5) comprising a depletion-type n-type-channel field effect transistor having the gate electric potential thereof applied by the voltage at the connection point between the third and fourth field effect transistors and a sixth field effect transistor (M6) comprising a depletion-type n-type-channel field effect transistor having a low-concentration n-type gate and having the gate and source thereof made to be the ground electric potential (GND), the fifth and sixth field effect transistors being connected in series; and a reference voltage is output from the connection point between the fifth and sixth field effect transistors (see FIG. 26).

The second voltage source circuit may comprise a first field effect transistor (M1) comprising a depletion-type n-type-channel field effect transistor having an n-type gate and having the gate and source thereof connected, and second and third field effect transistors (M2 and M3) each comprising an enhancement-type n-type-channel field effect transistor having a p-type gate and having the gate and drain thereof connected, the first, second and third field effect transistors being connected in series;

a first one of the first voltage source circuit may comprise a fourth field effect transistor (M4) comprising a depletion-type n-type-channel field effect transistor having a high-concentration n-type gate and a fifth field effect transistor (M5) comprising a depletion-type n-type-channel field effect transistor having a low-concentration n-type gate and having the gate and source thereof made to be a ground electric potential (GND), the fourth and fifth field effect transistors being connected in series;

a second one of the first voltage source circuit may comprise a sixth field effect transistor (M6) comprising a depletion-type n-type channel field effect transistor having a high-concentration n-type gate and having the gate electric potential thereof applied by the voltage at the connection point between the fourth and fifth field effect transistors and a seventh field effect transistor (M7) comprising a depletion-type n-type-channel field effect transistor having a low-concentration n-type gate and having the gate and source thereof made to be the ground electric potential (GND), the sixth and seventh field effect transistors being connected in series; and a reference voltage is output from the connection point between the sixth and seventh field effect transistors (see FIG. 27).

Field effect transistors of the first and second-voltage source circuits may at least partially have gates different in conductivity type or impurity concentration, and does not employ channel doping (see FIG. 28).

The second voltage source circuit may comprise a first field effect transistor (M1) comprising an enhancement-type n-type-channel field effect transistor having an n-type gate and having the gate and source thereof connected, and a second field effect transistor (M2) comprising an enhancement-type n-type-channel field effect transistor having a p-type gate and having the gate and drain thereof connected, the first and second field effect transistors being connected in series;

a first one of the first voltage source circuit may comprise a third field effect transistor (M3) comprising an n-type-channel field effect transistor having a high-concentration n-type gate and a fourth field effect transistor (M4) comprising an enhancement-type n-type-channel field effect transistor having a low-concentration n-type gate and having the gate and source thereof made to be a ground electric potential (GND), the third and fourth field effect transistors being connected in series;

a second part of the first voltage source circuit may comprise a fifth field effect transistor (M5) comprising an n-type-channel field effect transistor having a high-concentration n-type gate and having the gate electric potential thereof applied by the voltage at the connection point between the third and fourth field effect transistors and a sixth field effect transistor (M6) comprising an enhancement-type n-type-channel field effect transistor having a low-concentration n-type gate and having the gate and source thereof made to be the ground electric potential (GND), the fifth and sixth field effect transistors being connected in series; and a reference voltage is output from the connection point between the fifth and sixth field effect transistors (see FIG. 28).

Thereby, it is possible to achieve a voltage source circuit having a desired temperature characteristic without employing a minute current biasing circuit or a current biasing circuit for correcting temperature characteristic of conductivities. Especially, because above-mentioned various circuit configurations can be employed, it is possible to widen the range through which the present invention can be applied.

Further, the drain currents of each pair of the field effect transistors are made equal. Accordingly, as will be described, VPTAT and VPN can be obtained.

Further, each gate may comprise single-crystal silicon. Thereby, as will be described, it is possible to obtain VPTAT determined only by the impurity concentrations of the gates.

Alternatively, each gate may comprise polysilicon, and approximately 98% of the dangling bonds thereof may be terminated. Thereby, same as the case of the single-crystal silicon, it is possible to obtain VPTAT determined only by the impurity concentrations of the gates.

Alternatively, each gate may comprise polycrystal $Si_xGe_{1-x}$, and composition ratio of $Si_xGe_{1-x}$ may be such that approximately $0.01<X<0.5$ Thereby, same as the case of the single-crystal silicon, it is possible to obtain VPTAT determined only by the impurity concentrations of the gates.

Other objects and further features of the present invention will become more apparent from the following detailed description when read in conjunction with the accompanying drawings.

DETAILED DESCRIPTION OF THE PREFERRED EMBODIMENTS

The present invention is to achieve a proportional-to-absolute-temperature (PTAT) voltage source in CMOS process employing field effect transistors which can be used in a strong inversion range.

As a PTAT circuit using MOS transistors, one utilizing a weak inversion range is known. However, a biasing circuit for causing a minute current not larger than 2 nA to flow for keeping the transistors in the weak inversion range is needed. Further, a problematic shift in characteristics due to a leakage current due to influence of a parasitic diode may occur. Accordingly, such a configuration cannot be put into practice at a temperature not lower than 80° C. Therefore, the inventors propose a PTAT circuit using gates having different Fermi levels, and employing a pair of MOS transistors which can be used in a strong inversion range.

A difference in threshold voltage (Vt) between a pair of transistors M1 and M1 having a low-concentration (Ng1) n-type gate and a high-concentration (Ng2) n-type gate, respectively, is as follows:

$$\mathrm{VPTAT}=\mathrm{kT}/q\ln(Ng\mathbf{2}/Ng\mathbf{1})$$

in a condition where the carrier density is equal to the impurity concentration. Therefore, a voltage source having a voltage proportional to the absolute temperature can be formed thereof. For example, by employing a low-resistance polysilicon (20 Ω/sq; concentration of phosphorus: approximately $1\times e^{20}/cm^3$) and a high-resistance polysilicon (10 kΩ/sq; concentration of phosphorus: approximately $2\times e^{16}/cm^3$), used in an analog CMOS process, in a PTAT circuit, it is possible to achieve a PTAT voltage source such that VPTAT=0.211 (V) (room temperature).

A principle of the present invention will now be described.

According to the present invention, a PTAT voltage source employs field effect transistors (comprising MOS transistors in embodiments described below) which can be used also in a strong inversion range instead of a weak inversion range in which a stable operation cannot be performed due to leakage occurring at a temperature not lower than 80° C., and, by employing the PTAT voltage source, a voltage generating circuit is achieved.

According to Ong (ed), "Modern MOS Technology", McGraw-Hill, 1987 (reference H), page 46, a threshold voltage Vt for strongly inverting a MOS transistor is expressed as follows:

$$Vt=\phi_{MS}-Q_f/C_{ox}+2\phi_f-Qb/C_{ox}$$

There, $\phi_{MS}$ denotes the difference between the work function ϕm of the gate and the work function ϕs of the substrate; Qf denotes the fixed charge in the oxide film; $\phi_f$ denotes the Fermi level of the substrate; Qb denotes the charge within the depletion layer between the inversion layer and substrate; and $C_{ox}$ denotes the capacitance of the oxide film par unit area.

Figure 1:
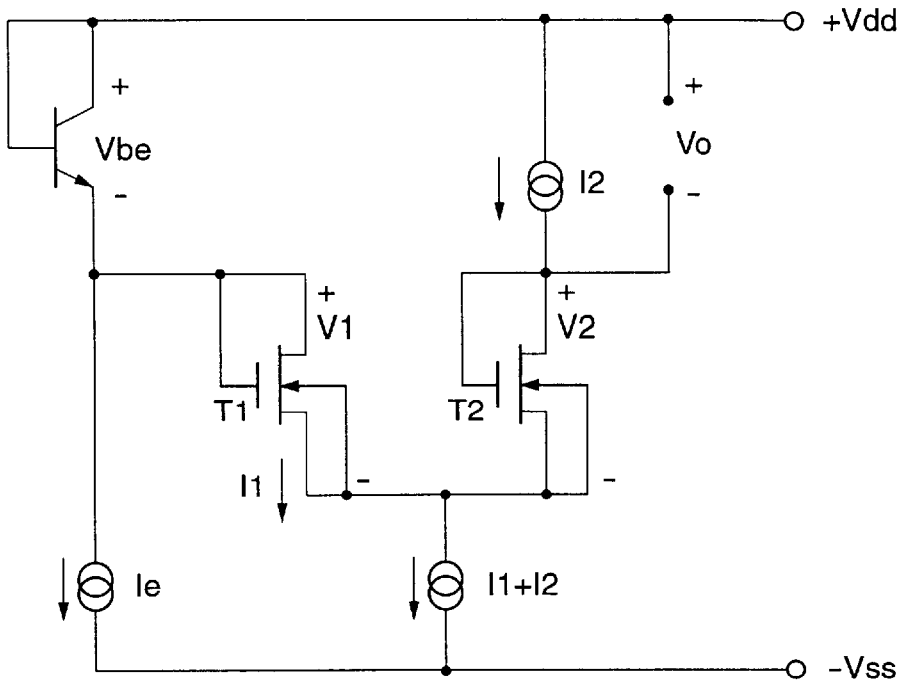
FIG.1 PRIOR ART
FIG. 1 shows a first example of circuit configuration in the related art.
Figure 2:
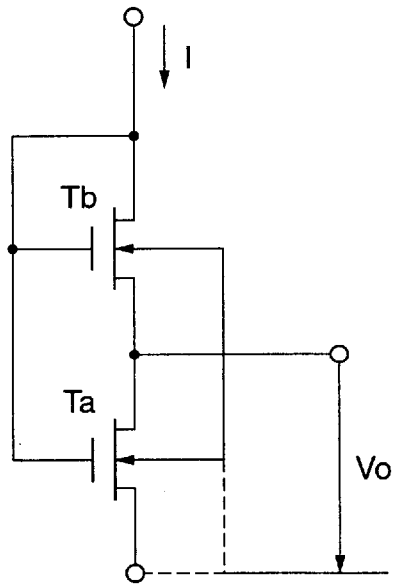
FIG.2 PRIOR ART
FIG. 2 shows a second example of circuit configuration in the related art.
Figure 3:
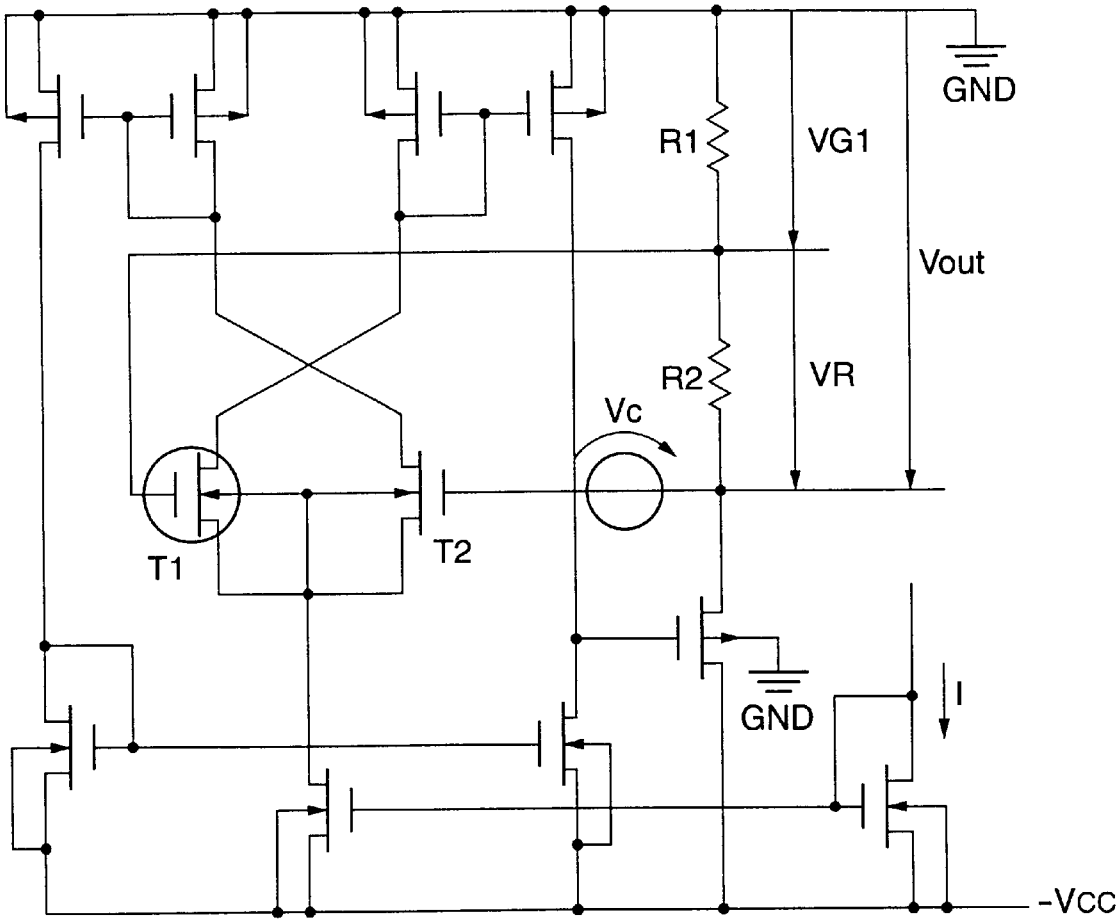
FIG.3 PRIOR ART
FIG. 3 shows a third example of circuit configuration in the related art.
Figure 4:
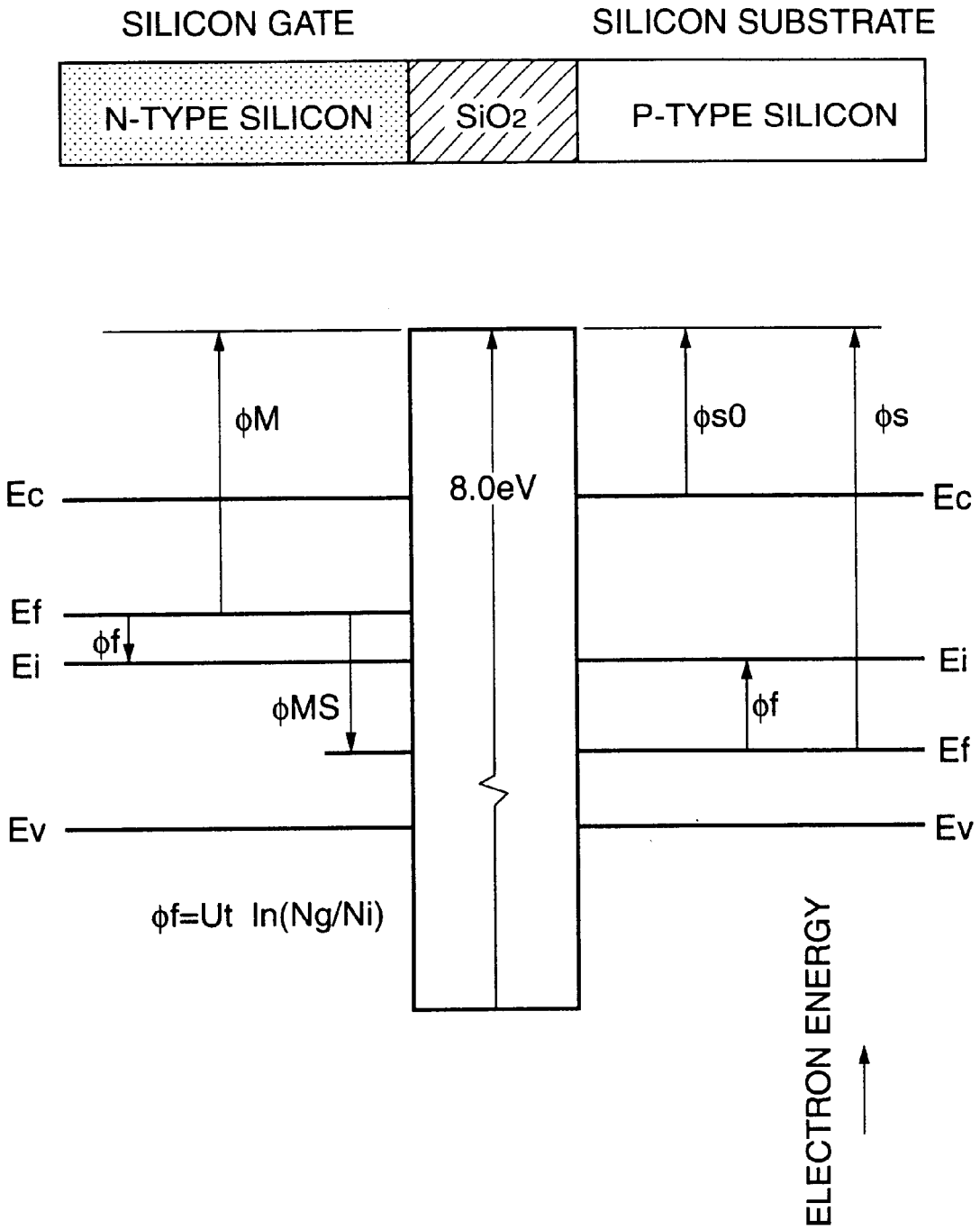
FIG. 4 shows a band diagram of a MOS transistor.

FIG. 4 shows a band diagram of a MOS transistor.

Further, $$\phi m=\phi_{so}+E_g/2\pm\phi_f$$

The sign of the third term $\phi_f$ of ϕm is positive when the gate is of p-type but is negative when it is of n-type. The difference in threshold voltage Vt between a pair of transistors having gates of semiconductor in the same conductive type but of low concentration (Ng1) and high concentration (Ng2) is equal to the difference in work function $\phi m$ of the gate material, and, also, is equal to the difference in Fermi level $\phi_f$ because the conductive type is the same as one another. Accordingly, the following equation holds (2) holds:

$$Vt1-Vt2=\phi m(Ng1)-\phi m(Ng2)=[Eg1/2-\phi_f(Ng1)]-[Eg1/2-\phi_f(Ng2)]=\phi_f(Ng2)-\phi_f(Ng1)=-kT/q\ \ln(Ng1/Ni)+kT/q\ \ln(Ng2/Ni)=kT/q\ \ln(Ng2/Ng1) \quad (2)$$

in condition where the carrier density is equal to the impurity concentration. There, k denotes the Boltzmann's constant, q denotes the charge of electron, T denotes the absolute temperature, Eg denotes the bandgap of silicon, Ni denotes the carrier density of intrinsic semiconductor.

Accordingly, $$VPTAT=(kT/q)\ln(Ng2/Ng1)$$

and, VPTAT determined only by the ratio of impurity concentrations of the gates can be obtained.

Figures 5, 6:
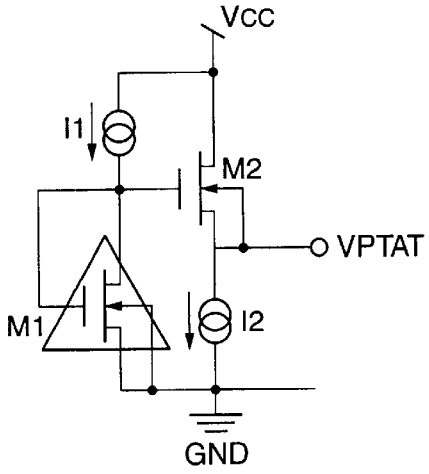
FIG. 5 illustrates a relationship between difference in phosphorus concentration Ng1, Ng2 and difference in VPTAT of a pair of transistors.
FIG. 6 shows a basic circuit configuration of a first embodiment of the present invention.

For example, as shown in FIG. 5, when a high-concentration n+ gate having a phosphorus concentration of approximately $1\times e^{20}/cm^3$ and a low-concentration n+ gate having a phosphorus concentration of approximately $2\times e^{16}/cm^3$, VPTAT=0.221 (V) (room temperature) can be obtained. When the phosphorus concentration of the high-concentration n+ gate is approximately $9\times10^{19}/cm^3$ as a result of decrease by 10% and the phosphorus concentration of the low-concentration n+ gate is approximately $2.2\times10^{16}/cm^3$ as a result of increase by 10% due to process variation, VPTAT=0.216 (V) (room temperature) is obtained. Further, when the phosphorus concentration of the high-concentration n+ gate is approximately $1.1\times10^{20}/cm^3$ as a result of increase by 10% and the phosphorus concentration of the low-concentration n+ gate is approximately $1.8\times10^{16}/cm^3$ as a result of increase by 10% due to process variation, VPTAT=0.227 (V) (room temperature) is obtained.

Thus, even when the phosphorus concentrations Ng1 and Ng2 of the gates of the pair of transistors change by 10%, the resulting change in VPTAT is on the order of several mV.

In order to produce such gates having different phosphorus concentrations, the following process may be executed: After a non-doped gate is deposited, a portion which is to be a low-concentration gate is masked by an oxide film, the remaining portion having no oxide film is high-concentration-doped through deposition of phosphorus, then, the portion to be of low-concentration portion is low-concentration-doped through ion implantation after the masking oxide film is removed through etching. Thereby, a pair of transistors having gates having the same conductive type but different Fermi levels $\phi_f$ can be produced. Because they are produced in the same process except doping to the gate, they have the same insulation film thickness, channel doping, channel length and channel width, but only different impurity concentrations. Accordingly, the difference in threshold voltage Vt is the difference of the gates in Fermi level $\phi_f$.

A method of obtaining the difference in Fermi level $\phi_f$ will now be described.

A drain current Id of a MOS transistor in a saturated range ($V_{DS}>V_{GS}-Vt$) is expressed as follows:

$$Id=(\beta/2)(V_{GS}-Vt)^2$$

Accordingly, drain currents $Id_1$ and $Id_2$ of a pair of MOS transistors M1 and M2 having gates of different concentrations are expressed as follows:

$$Id_1=(\beta_1/2)(V_{GS1}-V_{T1})^2$$

$$Id_2=(\beta_2/2)(V_{GS2}-V_{T2})^2$$

There, $V_{GS1}$ and $V_{GS2}$, and $V_{T1}$ and $V_{T2}$ denote gate-source voltages and threshold voltages of the MOS transistors M1 and M2, respectively. Further, $\beta_1$ and $\beta_2$ denote the conductivities of the MOS transistors M1 and M2, respectively, and each thereof can be expressed as follows:

$$\beta=\mu(\in_{ox}/T_{ox})(W_{eff}/L_{eff})$$

There, $\mu$ denotes the carrier mobility, $\in_{ox}$ denotes the dielectric constant of the oxide film, $T_{ox}$ denotes the thickness of the oxide film, $W_{eff}$ denotes the effective channel width, and $L_{eff}$ denotes the effective channel length.

The pair of MOS transistors have the same carrier mobility $\mu$, dielectric constant $\in_{ox}$ of the oxide films, thickness $T_{ox}$ of the oxide films, effective width $W_{eff}$ and effective channel length $L_{eff}$. Accordingly, $\beta_1=\beta_2$. Therefore, when assuming that $Id_1=Id_2$, the term of $\beta/2$ is cancelled, Accordingly, $$(V_{GS1}-V_{T1})^2=(V_{GS2}-V_{T2})^2$$

Then, $V_{GS}$ is biased appropriately, and the difference in threshold voltage Vt, that is, the difference in $\phi_f$ is obtained.

Thus, the principle of the PTAT voltage source has been described assuming that the carrier density is equal to the impurity concentration in the MOS transistors M1 and M2. However, they are not completely equal in many cases. This matter will now be described in detail.

First, in a case where a gate is of single crystal, the carrier density n is expressed by $$n=A\times Ng$$

There, A denotes the activation yield, and is a constant not more than 1. A is not influenced by the absolute temperature. Accordingly, the above-mentioned equation (2) becomes $$Vt1-Vt2=kT/q\ \ln(A_2\times Ng2)/(A_1\times Ng1)$$

Therefore, VPTAT determined only by the ratio of the impurity concentrations of the gates can be obtained.

Second, in a case where a gate is of polycrystalline silicon (polysilicon), the carrier density n is expressed by $$n=A\times Ng-B$$

There, A denotes the activation yield, and B is a value proportional to the reciprocal of the absolute temperature such that B 1/T. Accordingly, the above-mentioned equation (2) becomes $$Vt1-Vt2=kT/q\ \ln(A_2\times Ng2-B_2)/(A_1\times Ng1-B_1)$$

Therefore, VPTAT determined only by the ratio of the impurity concentrations of the gates cannot be obtained.

The value of B depends on the amount of dangling bonds. Accordingly, in order to obtain VPTAT using polysilicon, it is necessary that the value of (Vt1−Vt2) does not depend on the amount of dangling bonds. For this purpose, it is necessary to terminate the dangling bonds by hydrogen or the like, so that the terms of $B_1$ and $B_2$ in the above equation become so small that the terms of $B_1$ and $B_2$ can be ignored effectively. Thereby, VPTAT can be obtained.

Figure 29:
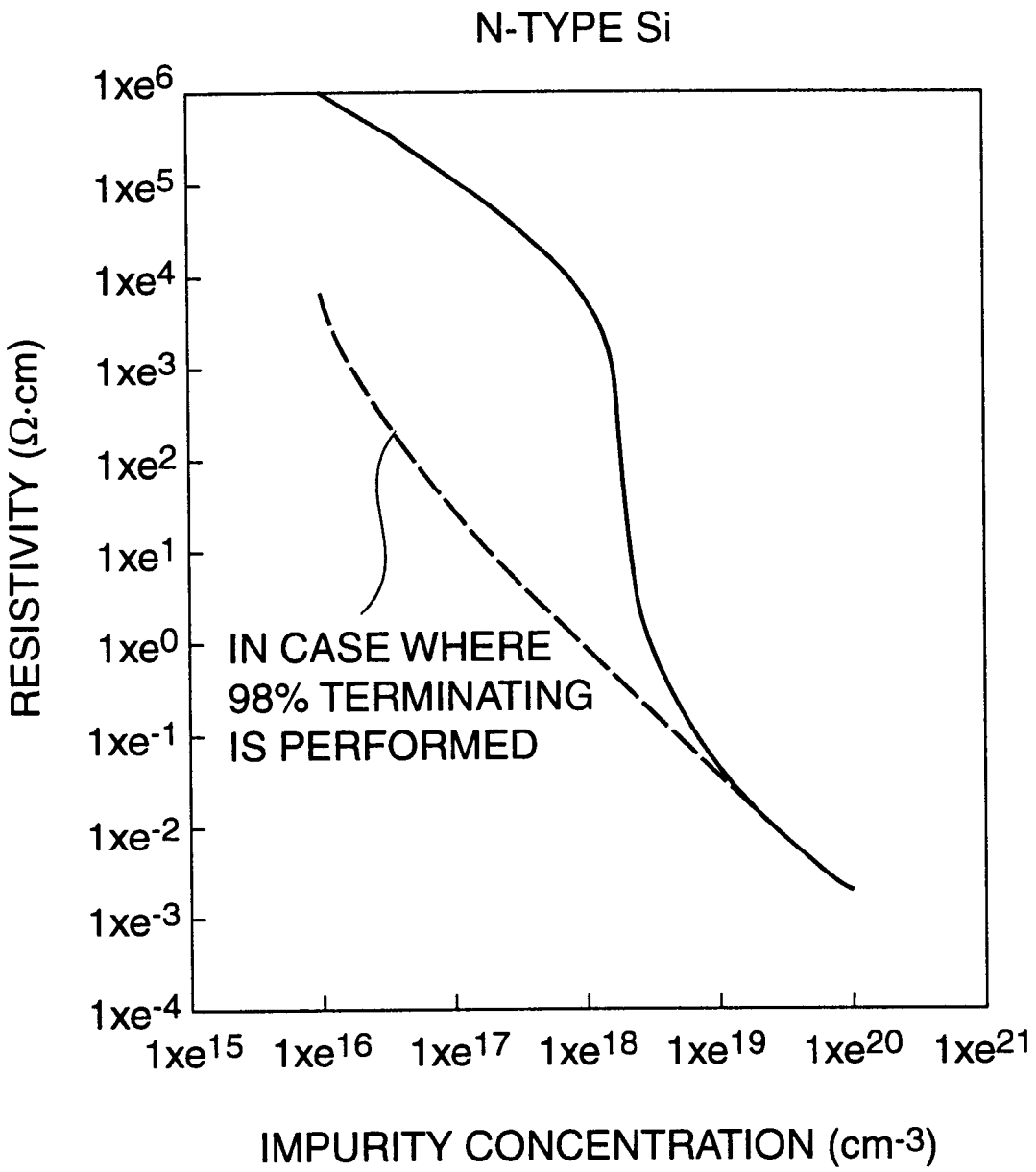
FIG. 29 shows a relationship between impurity concentration and resistivity of semiconductor for illustrating an influence of dangling bonds.

Specifically, it is necessary that not less than 98% of the dangling bonds are terminated by hydrogen or fluorine. The solid line shown in FIG. 29 shows a case where terminating by hydrogen or the like is not performed, while the broken line shows a case where not less than 98% of the dangling bonds are terminated. The broken line does not include a sharp change with respect to impurity concentration, as shown in the figure. This means that the dangling bonds almost vanish.

The dangling bonds will now be described in more detail. The amount of the dangling bonds can be measured by ESR (Electron Spin Resonance). Normally, although the forcible terminating by hydrogen or the like is not performed, on the order of 96% of the dangling bonds are terminated when impurity in high concentration ($2\times10^{19}$ $cm^{-3}$) is injected and the material is processed at high temperature (1000° C.), and, thereby, there is little temperature characteristic. However, in a case of the same impurity concentration and processing at the temperature of 900° C., only 93% are terminated. Accordingly, a large temperature characteristic coefficient is present. Therefore, by previously terminating not less than 98% of the dangling bonds by hydrogen or the like, it is possible to obtain satisfactory polysilicon having little temperature characteristic An example in a case where a gate is of polycrystalline $Si_xGe_{1-x}$ will now be described.

Polycrystalline $Si_xGe_{1-x}$, different from polysilicon, has a very high activation yield of impurity. Accordingly, influence of the dangling bonds is small, and, thereby, the carrier density is expressed by $$n=A\times Ng$$

Accordingly, VPTAT can be obtained same as the case of single crystal.

When the content of Ge is large in this case, the bandgap is small, and it is disadvantageous when a large VPTAT is obtained. Consideration of process variation, in order to obtain preferable VPTAT>0.2 (V), it is preferable that the composition ratio of $Si_xGe_{1-x}$ is such that $0.01<X<0.5$.

In each embodiment of the present invention which will be described, description is made such that gates are of polysilicon. However, it is not necessary to be limited to such configurations, and, as described above, the gates may be of single-crystal silicon. In a case where the gates are of polysilicon, not less than 98% of the dangling bonds thereof are terminated by hydrogen or the like. Alternatively, in a case where the gates are of polycrystalline $Si_xGe_{1-x}$, composition ratio of $Si_xGe_{1-x}$ is such that $0.01<X<0.5$.

Specific circuit configurations for obtaining the difference in threshold voltage Vt, that is, the difference in $\phi_f$ of a pair of transistors in embodiments of a voltage generating circuit employing a PTAT voltage source according to the present invention will now be described, with reference to figures.

In each of FIGS. 6 through 16, the gate of a MOS transistor M1 enclosed by a triangle is of an n-type polysilicon of low concentration (Ng1). A MOS transistor M2 has an n-type polysilicon gate of high concentration (Ng2).

Further, in each of the circuit configurations described below with reference to FIGS. 6 through 16, the MOS transistors M1 and M2 have the same thickness of oxide films, channel doping, channel length and channel width, but are different only in the impurity concentration.

Figure 7:
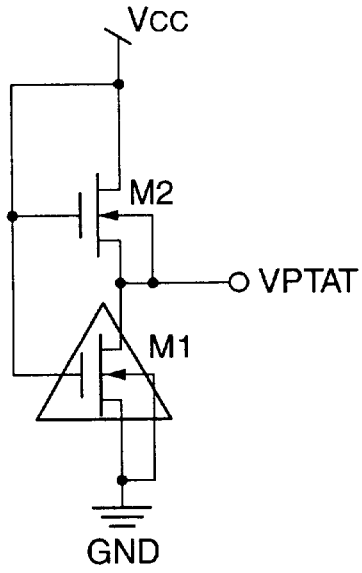
FIG. 7 shows a basic circuit configuration of a second embodiment of the present invention.

FIGS. 6 and 7 show basic configurations of embodiments employing pairs of gate-connected MOS transistors. In each of these cases, VPTAT is obtained as a difference in source voltage between the pair of MOS transistors.

FIG. 6 shows an example in which the MOS transistors M1 and M2 are connected in parallel according to a first embodiment of the present invention.

As shown in FIG. 6, in this circuit, between two power supply lines VCC and GND, a MOS transistor M1 having a gate of low-concentration (Ng1) n-type polysilicon and a MOS transistor M2 having a gate of high-concentration (Ng2) n-type polysilicon are connected in a manner such that the gates thereof are connected in common, and the gate and drain of the MOS transistor M1 having the gate of low-concentration are connected. In this configuration, the conductivities β of these MOS transistors are made equal to one another, and the drain-source currents (currents flowing between the drains and sources, respectively) thereof are made equal to one another (I1=I2).

By this configuration, the source electric potential of the MOS transistor M2 having the high-concentration (Ng2) n-type polysilicon gate (that is, the difference in source electric potential between the MOS transistor M1 having the low-concentration (Ng1) n-type polysilicon gate and MOS transistor M2 having the high-concentration (Ng2) n-type polysilicon gate, is obtained as $VPTAT=U_T\ln(Ng2/Ng1)$.

FIG. 7 shows an example in which the MOS transistors M1 and M2 are connected in serial according to a second embodiment of the present invention.

As shown in FIG. 7, in this circuit, between two power supply lines VCC and GND, a MOS transistor M1 having a gate of low-concentration (Ng1) n-type polysilicon and a MOS transistor M2 having a gate of high-concentration (Ng2) n-type polysilicon are connected in series, the gates thereof are connected in common and connected to the drain of the MOS transistor M2.

By this configuration, the source electric potential of the MOS transistor M2 having the high-concentration (Ng2) n-type polysilicon gate (that is, because the source electric potential of the MOS transistor M1 is the GND electric potential, the source electric potential of the MOS transistor M2 is equal to the difference in source electric potential between the MOS transistor M1 having the low-concentration (Ng1) n-type polysilicon gate and MOS transistor M2 having the high-concentration (Ng2) n-type polysilicon gate) is output as VPTAT which is the difference in Fermi level $\phi_f$, that is, $U_T\ln(Ng2/Ng1)$.

FIGS. 8, 9, 10 and 11 show circuits configurations in embodiments of the present invention in which source-connected pairs of MOS transistors are employed. In each of these cases, VPTAT is obtained as a difference in gate electric potential between the pair of MOS transistors.

Figure 8:
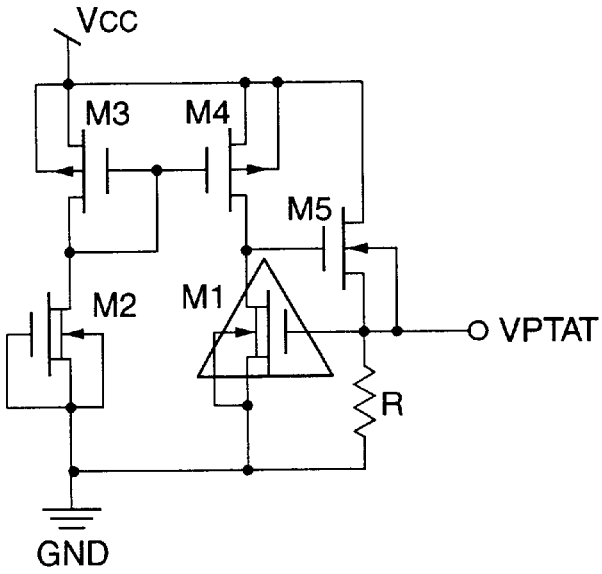
FIG. 8 shows a basic circuit configuration of a third embodiment of the present invention.

The circuit shown in FIG. 8 in a third embodiment according to the present invention includes a MOS transistor M1 having a gate of low-concentration (Ng1) n-type polysilicon, a MOS transistor M2 having a gate of high-concentration (Ng2) n-type polysilicon, p-type-channel MOS transistors M3 and M4, and an n-type-channel MOS transistor M5, connected between two power supply lines VCC and GND. In the configuration, the sources of the MOS transistor M1 having the gate of low-concentration (Ng1) n-type polysilicon and MOS transistor M2 having the gate of high-concentration (Ng2) n-type polysilicon are connected in common.

Specifically, the p-type-channel MOS transistors M3 and M4 form a current-mirror circuit, the p-type-channel MOS transistor M3 and n-type-channel MOS transistor M2 having the high-concentration (Ng2) n-type polysilicon gate are connected in series, the gate and source of this n-type-channel MOS transistor M2 are connected (constant-current connection), and the p-type-channel MOS transistor M4 and n-type-channel MOS transistor M1 having the low-concentration (Ng1) n-type polysilicon gate are connected in series. By the current-mirror function of the p-type-channel MOS transistors M3 and M4, the current same as that flowing through the constant-current-connected depletion-type MOS transistor M1 flows through the high-concentration (Ng2) n-type-channel MOS transistor M2.

Further, the drain of the n-type-channel MOS transistor M5 is connected to the power supply line VCC, the gate thereof is connected to the drain of the n-type-channel MOS transistor M1 and the source thereof is connected to the gate of the n-type-channel MOS transistor M1. The source-follower n-type-channel MOS transistor M5 biases the gate of the n-type-channel MOS transistor M1 so that $Id_{M1}=Id_{M2}$. By this configuration, the gate electric potential of the n-type-channel MOS transistor M1 (the source electric potential of the n-type-channel MOS transistor M5) is VPTAT. This VPTAT is equal to the difference in Fermi level, $U_T\ln(Ng2/Ng1)$.

Figure 9:
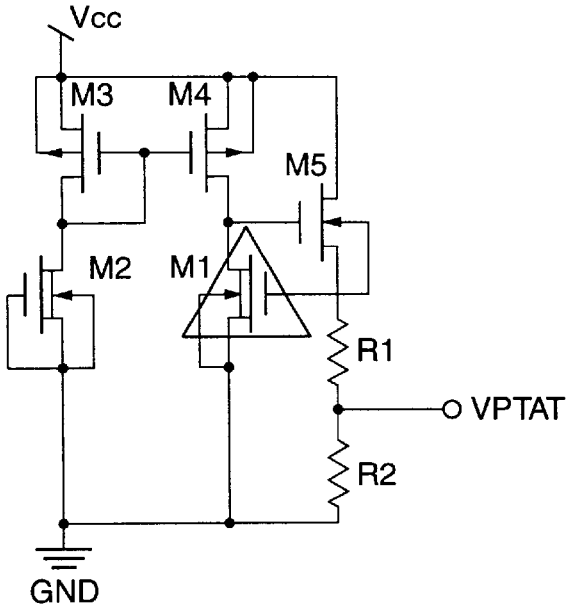
FIG. 9 shows a basic circuit configuration of a first variant embodiment of the third embodiment of the present invention.

FIG. 9 shows a first variant embodiment of the third embodiment shown in FIG. 8.

In the configuration shown in FIG. 9, the resistor R connected between the gate of the MOS transistor M1 having the low-concentration (Ng1) n-type polysilicon gate and the power supply line GND shown in FIG. 8 consists of resistors R1 and R2, and the output voltage VPTAT is obtained from the connection point between these resistors. At this time, the output voltage $VPTAT=\{R2/(R1+R2)\}U_T\ln(Ng2/Ng1)$.

Figure 10:
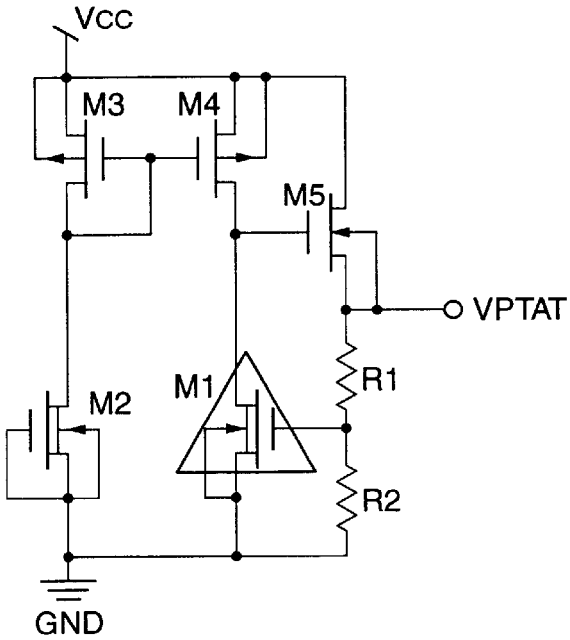
FIG. 10 shows a basic circuit configuration of a second variant embodiment of the third embodiment of the present invention.

FIG. 10 shows a second variant embodiment of the third embodiment shown in FIG. 8.

In the configuration shown in FIG. 10, the resistor R connected between the gate of the MOS transistor M1 having the low-concentration (Ng1) n-type polysilicon gate and the power supply line GND shown in FIG. 8 consists of a resistor R2, a resistor R1 is inserted between the gate of the MOS transistor M1 and the source of the n-type-channel MOS transistor M5, and the output voltage VPTAT is obtained from the source of the n-type-channel MOS transistor M5. At this time, the output voltage $VPTAT=\{(R1+R2)/R2\}U_T\ln(Ng2/Ng1)$.

Figure 11:
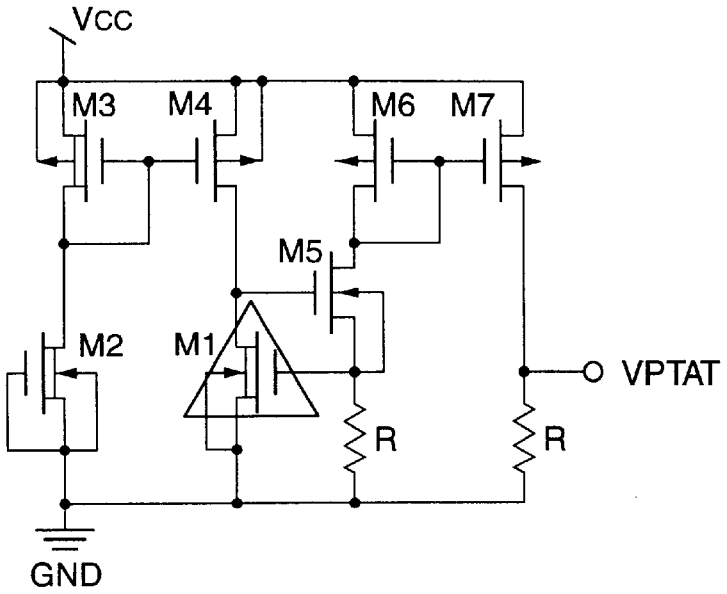
FIG. 11 shows a basic circuit configuration of a third variant embodiment of the third embodiment of the present invention.

FIG. 11 shows a third variant embodiment of the third embodiment shown in FIG. 8.

In the configuration shown in FIG. 11, a current-mirror circuit consisting of p-type-channel MOS transistors M6 and M7 is added in a current path of a current flowing through the resistor R connected between the gate and source of the MOS transistor M1 having the low-concentration (Ng1) n-type polysilicon gate, shown in FIG. 8, and the output voltage VPTAT is obtained from the source of the p-type-channel MOS transistor M7. At this time, the output voltage $VPTAT=MU_T\ln(Ng2/Ng1)$. There, "M" in this equation denotes a ratio of the current-mirror function.

As described above with reference to FIGS. 9, 10 and 11, by modifying the circuit shown in FIG. 8, it is possible to obtain the output voltage obtained as a result of the output voltage $U_T\ln(Ng2/Ng1)$ of FIG. 8 being multiplied by the resistance ratio or current ratio (ratio of current-mirror function). Accordingly, it is possible to arbitrarily correct the concentration ratio (Ng2/Ng1) which is a process factor by changing the resistance ratio or current ratio. In order to obtain VPTAT which is not dependent on the process, the concentration ratio which is the process factor may be corrected by adjusting the resistances of the above-mentioned resistors R1 and R2. For this purpose, trimming devices (resistance adjustment devices) for selectively applying laser light to resistor parts after the diffusion and deposition processes may be employed.

Figure 30:
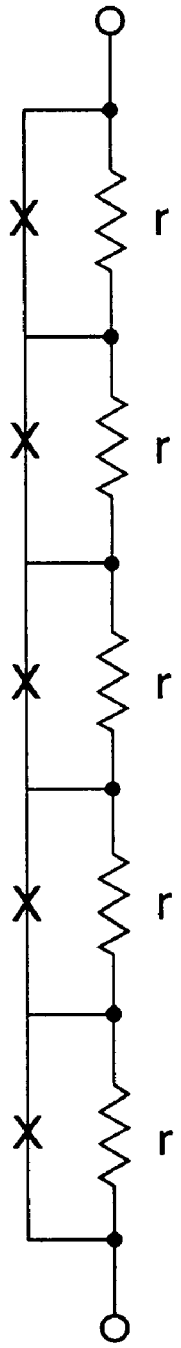
FIG. 30 illustrates a circuit diagram of one example of a resistor trimming configuration.

FIG. 30 shows an example of such a trimming device. In the figure, arbitrary ones of parts of symbols x are burned off by a laser light for series circuits of resistors r. Thereby, it is possible to obtain a desired resistance value (a multiple of the resistance value r). By using such devices, it is possible to adjust the resistance values of the above-mentioned resistors R1 and R2 easily.

Another circuit configuration in a fourth embodiment according to the present invention will now be described wherein a constant-current-connected depletion-type transistor M2 and a MOS transistor M1 having the same current flowing therethrough are used. In this case, the output VPTAT is the voltage $V_{GS}$ between the gate and source of the MOS transistor M1.

Figure 12A:
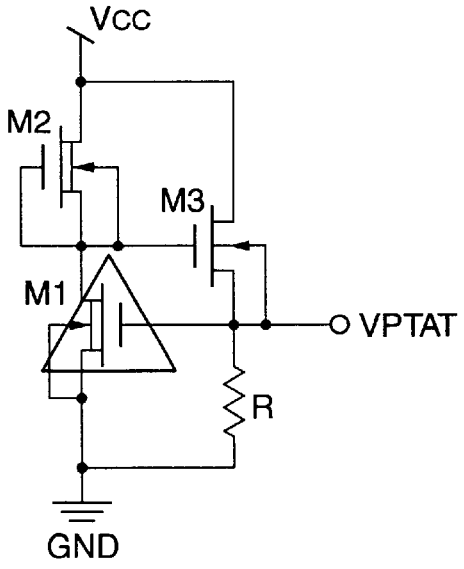
FIGS. 12A and 12B show basic circuit configurations of a fourth embodiment and a variant embodiment thereof of the present invention.
Figure 12B:
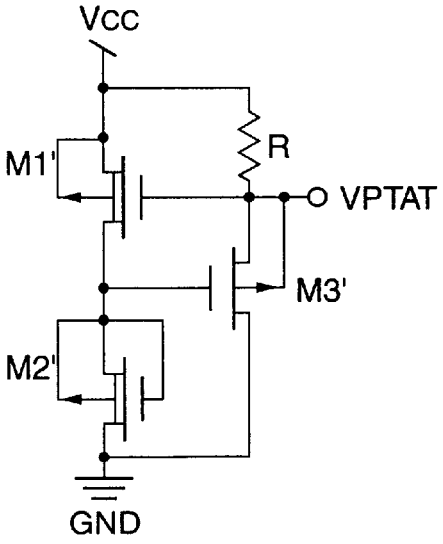

FIG. 12A shows a basic configuration of the fourth embodiment.

As shown in FIG. 12A, this circuit includes a depletion-type MOS transistor M2 having a high-concentration (Ng2) n-type polysilicon gate and a depletion-type MOS transistor M1 having a low-concentration (Ng1) n-type polysilicon gate connected in series between two power source lines VCC and GND. Further, the gate and source of the depletion-type MOS transistor M2 are connected to one another. Because of this constant-current connection, $V_{GS2}=0$.

Further, an n-type-channel MOS transistor M3 is provided, the gate of which is connected to the gate-source connected point of the depletion-type MOS transistor M2, the drain of which is connected to the power source line VCC, and the gate of which is connected to the gate of the depletion-type MOS transistor M1.

In this configuration, the voltage at the gate of the depletion-type MOS transistor M1 (source of the n-type-channel MOS transistor M3) is VPTAT. At this time, VPTAT is equal to the voltage $V_{GS1}$ between the gate and source of the depletion-type MOS transistor M1, and is the difference in Fermi level $U_T\ln(Ng2/Ng1)$. In the configuration shown in FIG. 12A, the MOS transistor M1 is of depletion type. However, the MOS transistor M1 may be of enhancement type.

Figure 13A:
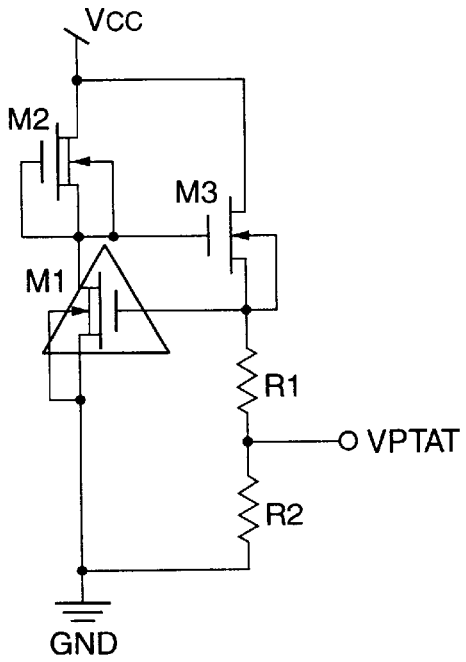
FIGS. 13A and 13B show basic circuit configurations of a first variant embodiment of the fourth embodiment and a further variant embodiment thereof of the present invention.
Figure 13B:
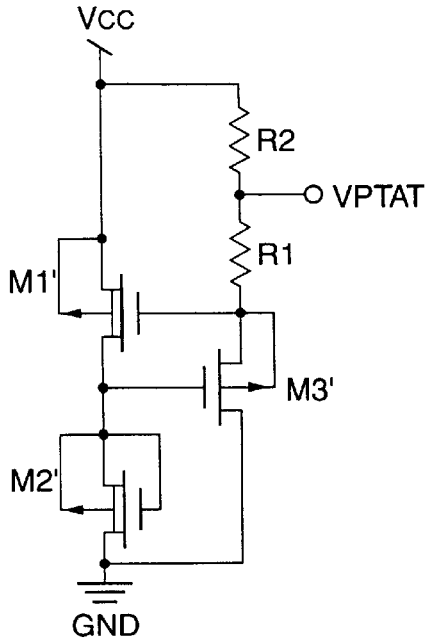

Further, a circuit configuration shown in FIG. 13A in a first variant embodiment of the fourth embodiment shown in FIG. 12A is possible.

In the configuration shown in FIG. 13A, the resistor R connected between the gate of the MOS transistor M1 having the low-concentration (Ng1) n-type polysilicon gate and the power supply line GND shown in FIG. 12A consists of resistors R1 and R2, and the output voltage VPTAT is obtained from the connection point between these resistors. At this time, the output voltage $VPTAT=\{R2/(R1+R2\}U_T\ln(Ng2/Ng1)$.

Figure 14A:
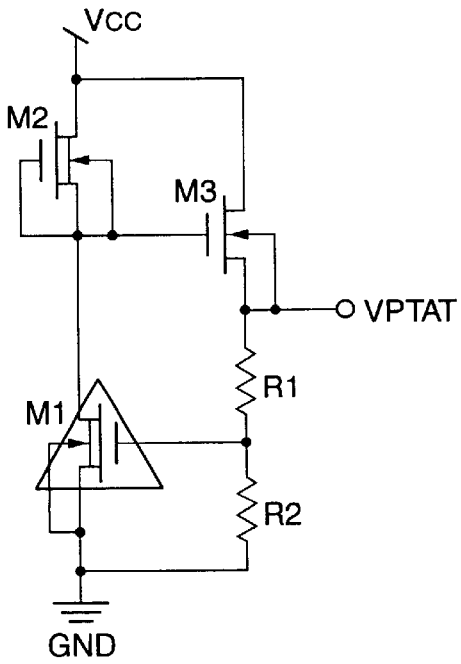
FIGS. 14A and 14B show basic circuit configurations of a second variant embodiment of the fourth embodiment and a further variant embodiment thereof of the present invention.
Figure 14B:
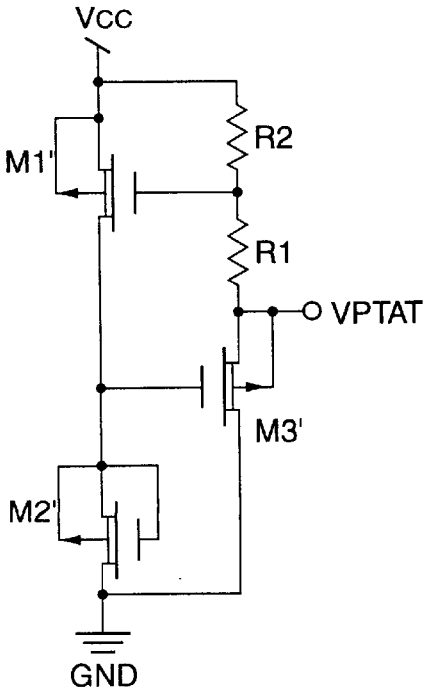

FIG. 14A shows a second variant embodiment of the fourth embodiment shown in FIG. 12A.

In the configuration shown in FIG. 14A, the resistor R connected between the gate of the MOS transistor M1 having the low-concentration (Ng1) n-type polysilicon gate and the power supply line GND shown in FIG. 12A consists of a resistor R2, a resistor R1 is inserted between the gate of the MOS transistor M1 and the source of the n-type-channel MOS transistor M3, and the output voltage VPTAT is obtained from the source of the n-type-channel MOS transistor M3. At this time, the output voltage $VPTAT=\{(R1+R2)/R2\}U_T\ln(Ng2/Ng1)$.

Figure 15:
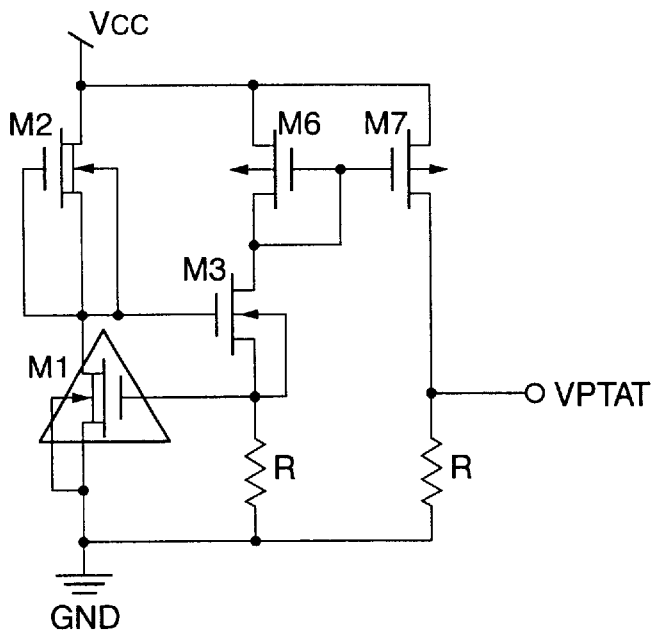
FIG. 15 shows a basic circuit configuration of a third variant embodiment of the fourth embodiment of the present invention.

FIG. 15 shows a third variant embodiment of the fourth embodiment shown in FIG. 12A.

In the configuration shown in FIG. 15, a current-mirror circuit consisting of p-type-channel MOS transistors M6 and M7 is added in a current path of a current flowing through the resistor R connected between the gate and source of the MOS transistor M1 having the low-concentration (Ng1) n-type polysilicon gate shown in FIG. 12A, and the output voltage VPTAT is obtained from the source of the p-type-channel MOS transistor M7. At this time, the output voltage VPTAT=$MU_T$ln(Ng2/Ng1). There, "M" in this equation denotes a ratio of the current-mirror function.

As described above with reference to FIGS. 13A, 14A and 15, by modifying the circuit shown in FIG. 12A, it is possible to obtain the output voltage obtained as a result of the output voltage $U_T$ln(Ng2/Ng1) of FIG. 12A being multiplied by the resistance ratio or current ratio (ratio M of the current-mirror function). Accordingly, it is possible to arbitrarily correct the concentration ratio (Ng2/Ng1) which is a process factor by changing the resistance ratio or current ration. In order to obtain VPTAT which is not dependent on the process, the concentration ratio which is the process factor may be corrected by adjusting the resistances of the above-mentioned resistors R1 and R2. For this purpose, a trimming device (resistance adjustment device) for selectively applying laser light to a resistor part after the diffusion and deposition processes may be employed, as mentioned above with reference to FIG. 30.

A circuit configuration in a fifth embodiment of the present invention will now be described, wherein gate voltages different to the amount of the difference in Fermi level are applied to a MOS transistor M1 having a low-concentration (Ng1) n-type polysilicon gate and a MOS transistor M2 having a high-concentration (Ng2) n-type polysilicon gate, and the gate conductances thereof being made to be equal.

Figure 16:
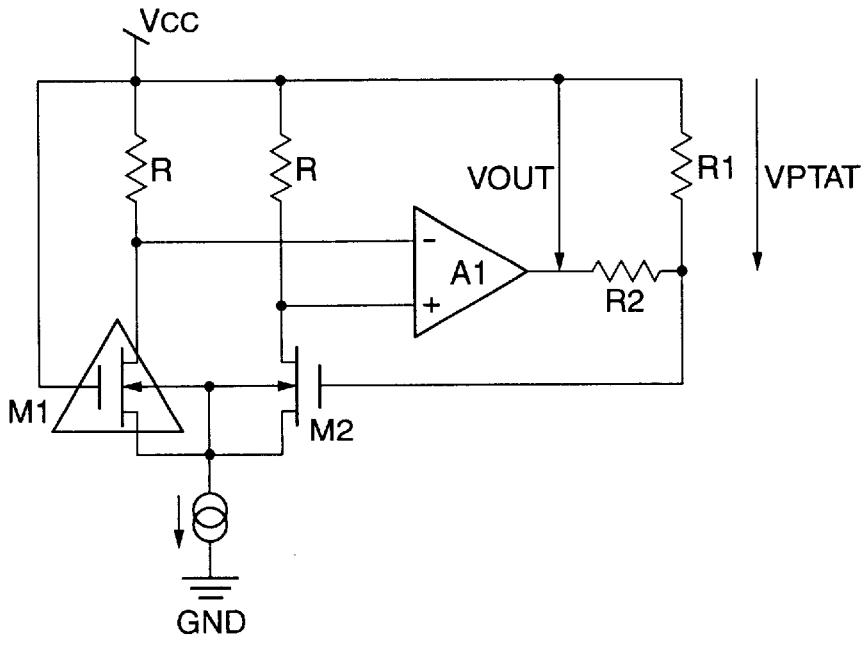
FIG. 16 shows a basic circuit configuration of a fifth embodiment of the present invention.

FIG. 16 shows a basic diagram of the circuit configuration in the fifth embodiment.

As shown in FIG. 16, this circuit includes the source-connected MOS transistor M1 having the low-concentration (Ng1) n-type polysilicon gate and the MOS transistor M2 having the high-concentration (Ng2) n-type polysilicon gate connected in parallel between two power supply lines VCC and GND, the electric potentials of the drains of the MOS transistor M1 and MOS transistor M2 are input to a differential amplifier A1, the output of the differential amplifier A1 is fed back to the gate of the MOS transistor M2 via a resistor R2. and a resistor R1 is provided between the power supply line VCC and the gate of the MOS transistor M2.

In this configuration, the voltage VCC is applied to the gate of the MOS transistor M1, the voltage lower than VCC by the amount dropped though the resistor R1 is applied to the gate of the MOS transistor M2, and the gate conductances thereof are made equal. The voltage applied to the gate of the MOS transistor M2 is VPTAT=$U_T$ln(Ng2/Ng1) in a condition in which VCC is the reference electric potential thereof as shown in FIG. 16, and the output of the differential amplifier A1 is VOUT=(R2/R1)$U_T$ln(Ng2/Ng1) in the condition in which VCC is the reference electric potential thereof as shown in FIG. 16.

The above-described embodiments are those employing n-type-channel MOS transistors as the MOS transistors M1 and M2. However, it is also possible to configure similar circuits employing p-type-channel MOS transistors. In these cases, the channel type (n-type-channel/p-type-channel) of each MOS transistor used in each embodiment should be inverted, and also, the power supply voltage is inverted between high voltage side and low voltage side (see FIGS. 12B, 13B and 14B).

A reference voltage source according to another aspect of the present invention will now be described.

In the related art, a reference voltage generating circuit employing a difference in threshold voltage between a depletion-type transistor and an enhancement-type transistor produced as a result of concentration of substrate or channel doping being changed is known. However, transistors having different concentration of substrate or channel doping have different conductivity and temperature characteristic thereof. Accordingly, it is difficult to achieve a reference voltage source having a desired temperature characteristic.

Therefore, according to the other aspect of the present invention, the concentrations of the substrates and channel doping thereof are made equal between each pair of MOS transistors, and a voltage source of VPTAT having a positive temperature coefficient of the pair of MOS transistors having semiconductor gates of the same conductivity type and different in impurity concentration, and a voltage source of VPN having a negative temperature coefficient of the pair of MOS transistors having semiconductor different in conductivity type are combined. Thereby, a desired reference voltage VREF=VPN+VPTAT is produced.

According to the other aspect of the present invention, a PTAT voltage source employs field effect transistors (comprising MOS transistors in embodiments described below) which can be used also in a strong inversion range instead of a weak inversion range in which a stable operation cannot be performed due to leakage occurring at a temperature not lower than 80° C., and, by employing the PTAT voltage source, a reference voltage source is achieved.

As mentioned above, $\beta_1=\beta 2$ for a pair of MOS transistors having the same carrier mobility $\mu$, dielectric constant $\in_{ox}$ of the oxide films, thickness $T_{ox}$ of the oxide films, effective width $W_{eff}$ and effective channel length $L_{eff}$. Accordingly, when $Id_1=Id_2$, $$(V_{GS1}-V_{T1})^2=(V_{GS2}-V_{T2})^2$$

Accordingly, $$V_{GS1}-V_{GS2}=V_{T1}V_{T2}$$

The difference in threshold voltage ($V_{T1}-V_{T2}$) of the pair of MOS transistors having gates of the same conductivity type and different in impurity concentration is a difference in Fermi level, and, as mentioned above, $$\text{VPTAT}=(\text{kT}/q)\ln(Ng2/Ni)-(\text{kT}/q)\ln(Ng1/Ni)=(\text{kT}/q)\ln(Ng2/Ng1)$$

There, k denotes Boltzmann's constant, T denotes the absolute temperature, q denotes the charge of the electron, Ng2 denotes the impurity concentration of the high-concentration gate, and Ng1 denotes the impurity concentration of the low-concentration gate. Accordingly, the difference in threshold voltage of the pair of MOS transistors is VPTAT having a positive temperature coefficient. Thus, the PTAT voltage source is obtained.

Further, similarly, the difference VPN in threshold voltage of a pair of MOS transistors having gates different in conductivity type and different in impurity concentration is the sum of the Fermi levels, and, $$VPN=(\text{kT}/q)\ln(Ng2/Ni)+(\text{kT}/q)\ln(Pg2/Ni)=(\text{kT}/q)\ln(Ng2\cdot Pg2/Ni^2)$$

The difference in threshold voltage of these pair of MOS transistors is VPN having a negative temperature coefficient, and, thus, a voltage source of VPN is obtained.

As disclosed in the above-mentioned reference D, VPN of a pair of MOS transistors having p-type high-concentration and n-type high-concentration polysilicon gates and having the same shape and same channel doping is the bandgap voltage ΔV of silicon (1.2 V at T=0; 1.12 V at T=room temperature), and also is the difference in threshold voltage of these pair of transistors. The shift in curve of drain current and gate-source electric potential difference also holds for the weak inversion range not higher than the threshold voltage and also for the transition range.

According to the other aspect of the present invention, a reference voltage source circuit having a desired temperature characteristic is achieved by a simple circuit including a combination of a voltage source of VPTAT having a positive temperature coefficient and a voltage source of VPN having a negative temperature coefficient.

Figures 17, 18:
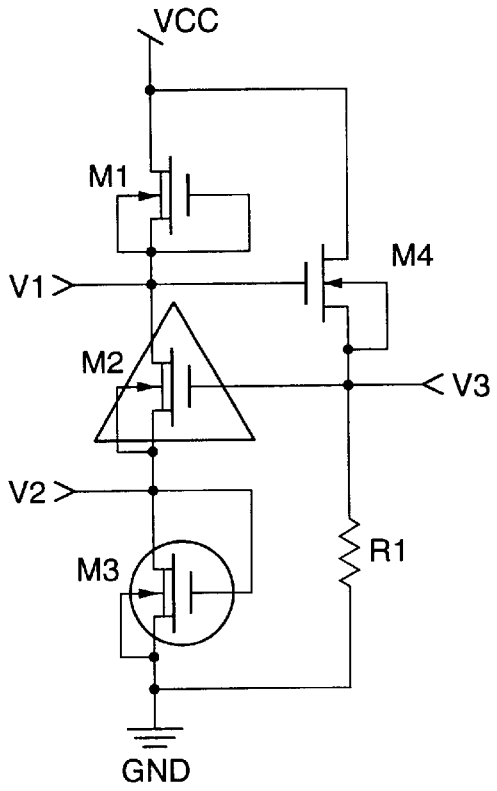
FIG. 17 shows a relationship between impurity concentration and threshold voltage of gates.
FIG. 18 shows a basic circuit configuration of a sixth embodiment of the present invention.

FIG. 17 shows a relationship between impurity in gate and threshold voltage.

In FIG. 17, NH denotes a high-concentration n-type gate (Ng2), NL denotes low-concentration n-type gate (Ng1). PH denotes high-concentration p-type gate (Pg2), and PL denotes low-concentration p-type gate (Pg1).

In circuits diagrams for describing embodiments of the other aspect of the present invention which will now be described, each transistor enclosed by a circle is a field effect transistor having a high-concentration p-type gate, each transistor enclosed by a square is a field effect transistor having a low-concentration p-type gate, and each transistor enclosed by a triangle is a field effect transistor having a low-concentration n-type gate.

FIG. 18 shows a circuit configuration in a sixth embodiment of the present invention.

In FIG. 18, field effect transistors M1, M2 and M3 are all n-type-channel ones, have the same impurity concentration in substrate and also in channel doping, are formed in a p-well in an n-type substrate, and the substrate electric potential of each field effect transistor is made equal to the source electric potential thereof. The ratio S=W/L of the channel width and channel length is equal to each other. That is, Sm1=Sm2=Sm3, where Smi denotes the ratio of the channel width W and channel length L of the field effect transistor Mi.

The field effect transistor M1 is of depletion type and has a high-concentration n-type gate, and the gate and source thereof are connected so that the transistor M1 forms a constant current source. The field effect transistor M2 has a low-concentration n-type gate. The gate electric potential of the transistor M2 is provided by a source-follower circuit including a n-type-channel field effect transistor M4 and a resistor R1. The field effect transistor M3 is of enhancement type and has a p-type gate, and the gate and drain thereof are connected.

The same current flows through the pair of field effect transistors M1 and M3. Accordingly, the voltage between the gate and source of the field effect transistor M3, that is, V2 is VPN mentioned above. Further, the pair of field effect transistors M1 and M2 are biased by the source-follower circuit so that the same current flow therethrough. Accordingly, the voltage between the gate and source of the field effect transistor M2 is VPTAT mentioned above.

Accordingly, the gate electric potential V3 of the field effect transistor M2 is:

$$V3=VPN+\mathrm{VPTAT}(=Vref\text{: reference voltage})$$

The temperature characteristic of V3 can be arbitrarily set by changing impurity concentrations of the high-concentration n-type gate(s), low-concentration n-type gate (s) and p-type gate(s).

Figure 19:
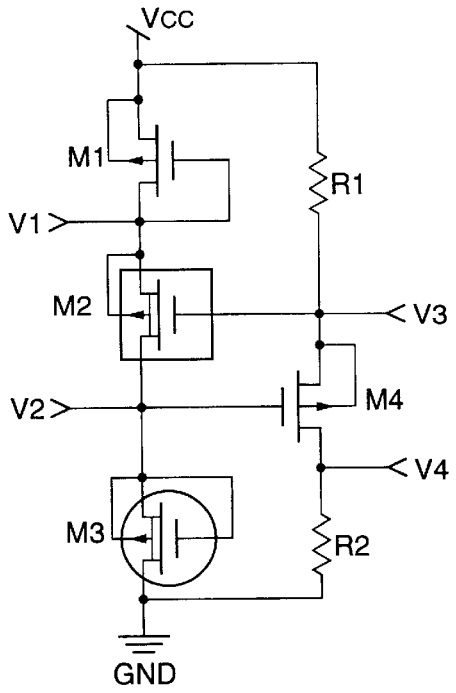
FIG. 19 shows a basic circuit configuration of a seventh embodiment of the present invention.

FIG. 19 shows a circuit configuration in a seventh embodiment of the present invention.

In FIG. 19, field effect transistors M1, M2 and M3 are all p-type-channel ones, have the same impurity concentration in substrate and also in channel doping, are formed in an n-well in a p-type substrate, and the substrate electric potential of each field effect transistor is made equal to the source electric potential thereof. The ratio S=W/L of the channel width and channel length is equal to each other. That is, Sm1=Sm2=Sm3, where Smi denotes the ratio of the channel width W and channel length L of the field effect transistor Mi.

The field effect transistor M1 is of enhancement type and has a high-concentration n-type gate, and the gate and drain thereof are connected. The field effect transistor M2 has a low-concentration p-type gate. The gate electric potential of the transistor M2 is applied by a source-follower circuit including a p-type-channel field effect transistor M4 and a resistor R1 (in a case where a resistor R2 shown in the figure is not provided, and is short-circuited). The field effect transistor M3 is of depletion type and has a p-type gate, and the gate and source thereof are connected so that the transistor M3 acts as a constant current source.

The same current flows through the pair of field effect transistors M1 and M3. Accordingly, the voltage between the gate and source of the field effect transistor M1, that is, (VCC−V1) is VPN mentioned above. Further, the pair of field effect transistors M1 and M2 are biased by the source-follower circuit so that the same current flow therethrough. Accordingly, the voltage between the gate and source of the field effect transistor M2, that is, (V1−V3) is VPTAT mentioned above.

Accordingly, the difference (VCC−V3) between the power source voltage VCC and the gate electric potential V3 of the field effect transistor M2 is:

$$VCC-V3=VPN+\mathrm{VPTAT}(=Vref\text{: reference voltage } 1)$$

The temperature characteristic of (VCC−V3) can be arbitrarily set by changing impurity concentrations of the high-concentration n-type gate(s), low-concentration n-type gate (s) and p-type gate(s).

Further, when the resistor R2 is inserted as shown in FIG. 19, $$V4=(VPN+\mathrm{VPTAT})\cdot R2/R1\ (=Vref2\text{: reference voltage } 2)$$

Accordingly, it is possible to achieve a reference voltage source in which the output voltage V4, which the voltage GND is the reference voltage of, can be adjusted by the resistance ratio R2/R1.

Figure 20:
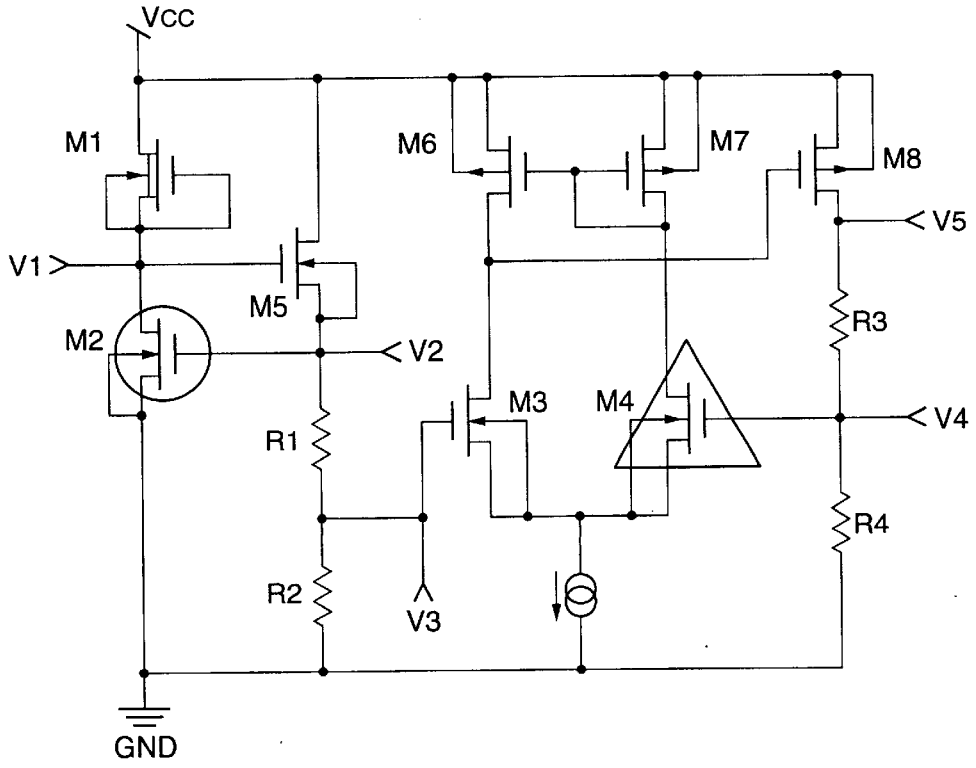
FIG. 20 shows a basic circuit configuration of an eighth embodiment of the present invention.

FIG. 20 shows a circuit configuration in an eighth embodiment of the present invention.

In FIG. 20, field effect transistors M1, M2, M3 and M4 are all n-type-channel ones, have the same impurity concentration in substrate and also in channel doping, are formed in a p-well in an n-type substrate, and the substrate electric potential of each field effect transistor is made equal to the source electric potential thereof. The ratio S=W/L of the channel width W and channel length L is equal to each other. That is, Sm1=Sm2=Sm3=Sm4, where Smi denotes the ratio of the channel width W and channel length L of the field effect transistor Mi.

The field effect transistor M1 is of depletion type and has a high-concentration n-type gate, and the gate and source thereof are connected so that the transistor M1 acts as a constant current source. The field effect transistor M2 has a high-concentration p-type gate. The gate electric potential of the transistor M2 is provided by a source-follower circuit including a n-type-channel field effect transistor M5 and resistors R1 and R2. The field effect transistor M3 has a high-concentration n-type gate. The field effect transistor M4 has a low-concentration n-type gate.

The same current flows through the pair of field effect transistors M1 and M2. Accordingly, the voltage between the gate and source of the field effect transistor M2, that is, V2 is VPN mentioned above. The pair of field effect transistors M3 and M4 are input transistors of a differential amplifier and have the same current flowing therethrough by a current-mirror circuit of the p-type-channel MOS transistors M6 and M7. Accordingly, the differential amplifier has the input offset of VPTAT. VPN·R2/(R1+R2) is applied to the gate of the field effect transistor M3 by the source-follower circuit. Further, the gate electric potential V4 of the field effect transistor M4 is $$VPN \cdot R2/(R1+R2)+\mathrm{VPTAT}$$

through a feedback loop including the differential amplifier having the offset of VPTAT, a p-type-channel field effect transistor M8 and resistors R3 and R4.

Accordingly, as the drain electric potential V5 of the field effect transistor M8, $$V5=\{VPN \cdot R2/(R1+R2)+\mathrm{VPTAT}\} \cdot (R3+R4)/R4 \ (=Vref\text{: reference voltage})$$

is obtained.

The electric potential V5 can be adjusted arbitrarily by changing impurity concentrations of the high-concentration n-type gate(s), low-concentration n-type gate(s) and p-type gate(s) or resistances of the resistors R1 and R2. Further, the reference voltage source in which the electric potential V5 can be arbitrarily set by changing the resistance ratio of the resistors R3 and R4 is achieved. Furthermore, by the field effect transistor M8, it is possible to increase the current driving capability.

Figure 21:
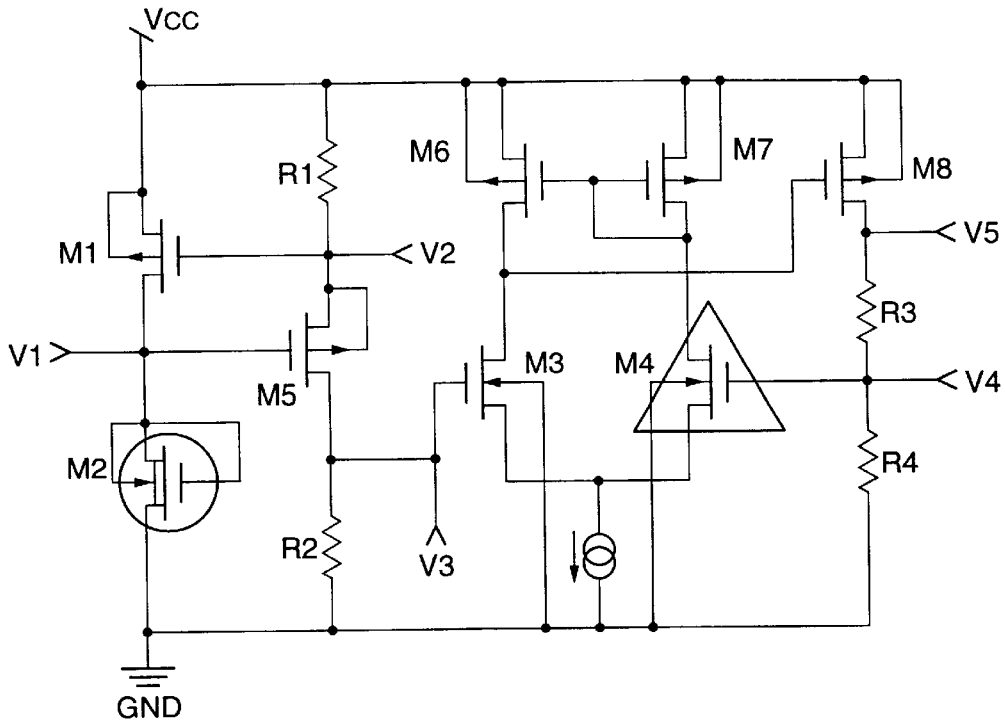
FIG. 21 shows a basic circuit configuration of a ninth embodiment of the present invention.

FIG. 21 shows a circuit configuration in a ninth embodiment of the present invention.

In FIG. 21, field effect transistors M1 and M2 are p-type-channel ones, have the same impurity concentration in substrate and also in channel doping, are formed in an n-well in a p-type substrate, and the substrate electric potential of each field effect transistor is made equal to the source electric potential thereof. Field effect transistors M3 and M4 are n-type-channel ones, have the same impurity concentration in substrate and also in channel doping, are formed in a p-well in a p-type substrate, and the substrate electric potential of each field effect transistor is made different from the source electric potential thereof and equal to the electric potential of GND. The ratio S=W/L of the channel width W and channel length L of each transistor is such that Sm1=Sm2, and Sm3=Sm4, where Smi denotes the ratio of the channel width W and channel length L of the field effect transistor Mi.

The field effect transistor M2 is of depletion type and has a high-concentration p-type gate, and the gate and source thereof are connected so that the transistor M2 acts as a constant current source. The field effect transistor M1 has a high-concentration n-type gate. The gate electric potential of the transistor M1 is applied by a source-follower circuit including a p-type-channel field effect transistor M5 and resistors R1 and R2. The field effect transistor M3 has a high-concentration n-type gate. The field effect transistor M4 has a low-concentration n-type gate.

The same current flows through the pair of field effect transistors M1 and M2. Accordingly, the voltage between the gate and source of the field effect transistor M1 is VPN mentioned above. The pair of field effect transistors M3 and M4 are input transistors of a differential amplifier and have the same current flowing therethrough by a current-mirror circuit of the p-type-channel MOS transistors M6 and M7. Accordingly, the differential amplifier has the input offset of VPTAT.

$$V3=VPN \cdot R2/(R1+R2)$$

is applied to the gate of the field effect transistor M3 by the source-follower circuit. Further, the gate electric potential V4 of the field effect transistor M4 is $$V4=VPN \cdot R2/(R1+R2)+\mathrm{VPTAT}(=Vref1\text{: reference voltage } 1)$$

through a feedback loop including the differential amplifier having the offset of VPTAT, a p-type-channel field effect transistor M8 and resistors R3 and R4.

Accordingly, as the drain electric potential V5 of the field effect transistor M8, $$V5=\{VPN \cdot R2/(R1+R2)+\mathrm{VPTAT}\} \cdot (R3+R4)/R4(=Vref2\text{: reference voltage } 2)$$

is obtained.

The electric potential V4 can be adjusted arbitrarily by changing impurity concentrations of the high-concentration n-type gate(s), low-concentration n-type gate(s) and p-type gate(s) or resistances of the resistors R1 and R2.

Further, the reference voltage source in which the electric potential V5 can be arbitrarily set by changing the resistance ratio of the resistors R3 and R4 is achieved. Furthermore, by the field effect transistor M8, it is possible to increase the current driving capability.

Thus, it is possible to employ a pair of transistors in which the source voltage and substrate voltage are different and back-bias is applied, in a voltage source for VPN and VPTAT, as a result of the voltage of back-bias being made equal.

Figure 22:
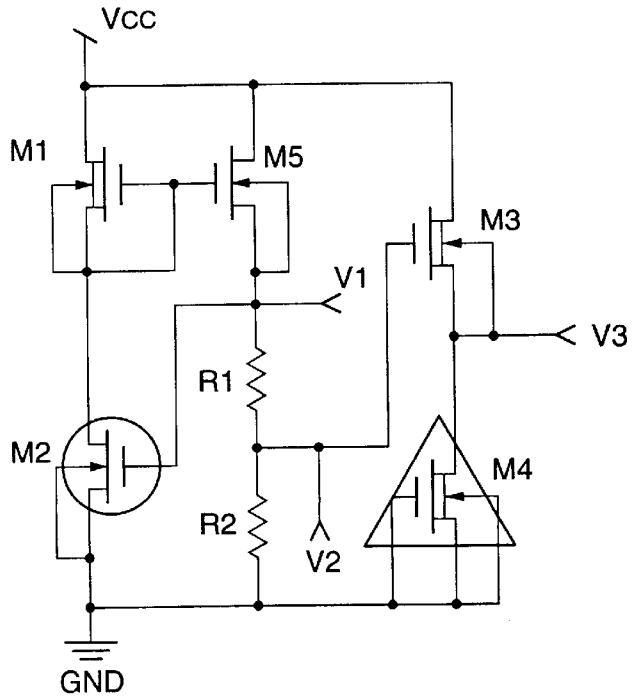
FIG. 22 shows a basic circuit configuration of a tenth embodiment of the present invention.

FIG. 22 shows a circuit configuration in a tenth embodiment of the present invention.

In FIG. 22, field effect transistors M1, M2, M3 and M4 are all n-type-channel ones, have the same impurity concentration in substrate and also in channel doping, are formed in a p-well in an n-type substrate, and the substrate electric potential of each field effect transistor is made equal to the source electric potential thereof. The ratio S=W/L of the channel width W and channel length L of each transistor is such that Sm1=Sm2, and Sm3=Sm4, where Smi denotes the ratio of the channel width W and channel length L of the field effect transistor Mi.

The field effect transistor M1 is of depletion type and has a high-concentration n-type gate, and the gate and source thereof are connected so that the transistor M1 acts as a constant current source. The field effect transistor M2 has a high-concentration p-type gate. The gate electric potential of the transistor M2 is applied by a source-follower circuit including a n-type-channel field effect transistor M5 and a resistor R2 (in a case where a resistor R1 shown in the figure is not provided, and is short-circuited). The field effect transistor M3 is of a depletion type and has a high-concentration n-type gate. The field effect transistor M4 is of a depletion type, has a low-concentration n-type gate and the gate and source thereof are connected so that the transistor M4 acts as a constant current source.

The same current flows through the pair of field effect transistors M1 and M2. Accordingly, the voltage between the gate and source of the field effect transistor M2 is VPN mentioned above. Further, the same current flows through the pair of field effect transistors M3 and M4. Accordingly, the voltage between the gate and source of the field effect transistor M3 is VPTAT mentioned above.

Accordingly, the source electric potential V3 of the field effect transistor M3 is:

$$V3=VPN-(-\mathrm{VPTAT})=VPN+\mathrm{VPTAT}(=Vref1\text{: reference voltage } 1)$$

The temperature characteristic of V3 can be arbitrarily set by changing the impurity concentrations of the high-concentration n-type gate(s), low-concentration n-type gate (s) and p-type gate(s).

Furthermore, by inserting the resistor R1 into the source-follower circuit as shown in FIG. 22, $$V3=VPN\cdot R2/(R1+R2)+\text{VPTAT}(=Vref2\text{: reference voltage } 2)$$

Thus, the reference voltage source in which the temperature characteristic of the output voltage V3 can be set also by the resistance ratio is achieved.

Figure 23:
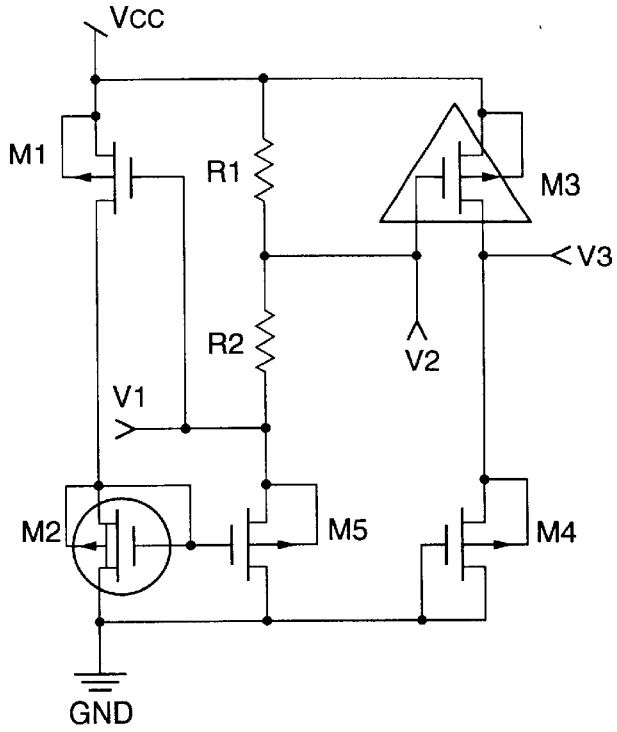
FIG. 23 shows a basic circuit configuration of an eleventh embodiment of the present invention.

FIG. 23 shows a circuit configuration in an eleventh embodiment of the present invention.

In FIG. 23, field effect transistors M1, M2, M3 and M4 are all p-type-channel ones, have the same impurity concentration in substrate and also in channel doping, are formed in an n-well in a p-type substrate, and the substrate electric potential of each field effect transistor is made equal to the source electric potential thereof. The ratio S=W/L of the channel width W and channel length L of each transistor is such that Sm1=Sm2, and Sm3=Sm4, where Smi denotes the ratio of the channel width W and channel length L of the field effect transistor Mi.

The field effect transistor M1 has a high-concentration n-type gate. The gate electric potential of the transistor M1 is applied by a source-follower circuit including a p-type-channel field effect transistor M5 and a resistor R1 (in a case where a resistor R2 shown in the figure is not provided, and is short-circuited). The field effect transistor M2 is of depletion type and has a high-concentration p-type gate, and the gate and source thereof are connected so that the transistor M2 acts as a constant current source. The field effect transistor M3 has a low-concentration n-type gate. The field effect transistor M4 has a high-concentration n-type gate.

The same current flows through the pair of field effect transistors M1 and M2. Accordingly, the voltage between the gate and source of the field effect transistor M1 is −VPN mentioned above. Further, the same current flows through the pair of field effect transistors M3 and M4. Accordingly, the voltage between the gate and source of the field effect transistor M4 is $(-\text{VPTAT}+V_{GSM3})$ Accordingly, the source electric potential V3 of the field effect transistor M4 is:

$$V3=VPN+\text{VPTAT}(=Vref1\text{: reference voltage } 1)$$

The temperature characteristic of V3 can be arbitrarily set by changing the impurity concentrations of the high-concentration n-type gate(s), low-concentration n-type gate (s) and p-type gate(s).

Furthermore, by inserting the resistor R2 into the source-follower circuit as shown in FIG. 23, $$V3=VPN\cdot R2/(R1+R2)+\text{VPTAT}(=Vref2\text{: reference voltage } 2)$$

Thus, the reference voltage source in which the temperature characteristic of the output voltage V3 can be set also by the resistance ratio.

Figure 24:
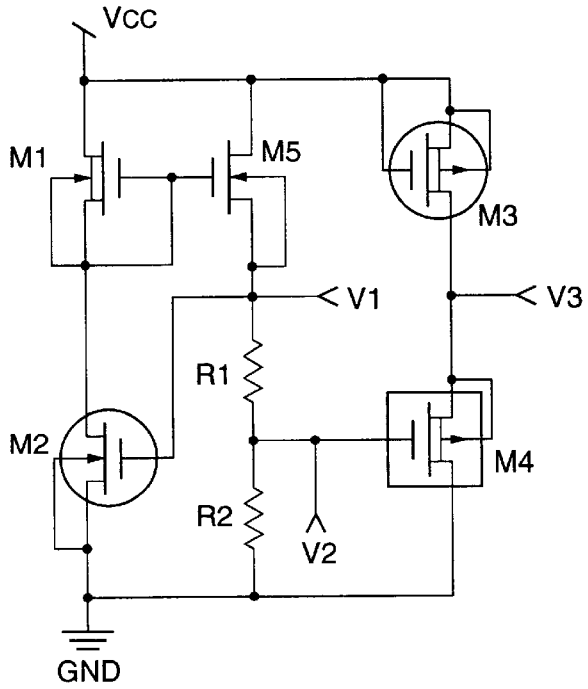
FIG. 24 shows a basic circuit configuration of a twelfth embodiment of the present invention.

FIG. 24 shows a circuit configuration in a twelfth embodiment of the present invention.

In FIG. 24, field effect transistors M1 and M2, are n-type-channel field effect transistors, have the same impurity concentration in substrate and also in channel doping, are formed in a p-well in an n-type substrate, and the substrate electric potential of each field effect transistor is made equal to the source electric potential thereof. Field effect transistors M3 and M4, are p-type-channel field effect transistors, have the same impurity concentration in substrate and also in channel doping, are formed in an n-well separate from the n-type substrate, and the substrate electric potential of each field effect transistor is made equal to the source electric potential thereof. The ratio S=W/L of the channel width W and channel length L of each transistor is such that Sm1=Sm2, and Sm3=Sm4, where Smi denotes the ratio of the channel width W and channel length L of the field effect transistor Mi.

The field effect transistor M1 is of depletion type and has a high-concentration n-type gate, and the gate and source thereof are connected so that the transistor M1 acts as a constant current source. The field effect transistor M2 has a high-concentration p-type gate. The gate electric potential of the transistor M2 is applied by a source-follower circuit including an n-type-channel field effect transistor M5 and a resistor R2 (in a case where a resistor R1 shown in the figure is not provided, and is short-circuited). The field effect transistor M3 is of depletion type, has a high-concentration p-type gate, and the gate and source thereof are connected so that the transistor M3 acts as a constant current source. The field effect transistor M4 has a low-concentration p-type gate.

The same current flows through the pair of field effect transistors M1 and M2. Accordingly, the voltage between the gate and source of the field effect transistor M2 is VPN mentioned above. Further, the same current flows through the pair of field effect transistors M3 and M4. Accordingly, the voltage between the gate and source of the field effect transistor M4 is −VPTAT.

Accordingly, the source electric potential V3 of the field effect transistor M4 is:

$$V3\ VPN+\text{VPTAT}(=Vref1\text{: reference voltage } 1)$$

The temperature characteristic of V3 can be arbitrarily set by changing the impurity concentrations of the high-concentration p-type gate(s), low-concentration p-type gate (s) and n-type gate(s).

Furthermore, by inserting the resistor R1 into the source-follower circuit as shown in FIG. 24, $$V3=VPN\cdot R2/(R1+R2)+\text{VPTAT}(=Vref2\text{: reference voltage } 2)$$

Thus, the reference voltage source in which the temperature characteristic of the output voltage V3 can be set also by the resistance ratio is achieved.

Figure 25:
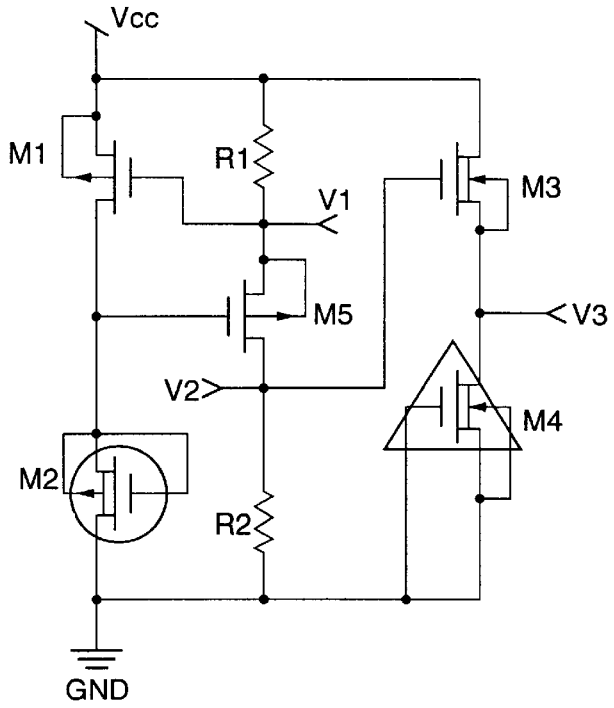
FIG. 25 shows a basic circuit configuration of a thirteenth embodiment of the present invention.

FIG. 25 shows a circuit configuration in a thirteenth embodiment of the present invention.

In FIG. 25, field effect transistors M1 and M2, are p-type-channel field effect transistors, have the same impurity concentration in substrate and also in channel doping, are formed in an n-well separate from an n-type substrate, and the substrate electric potential of each field effect transistor is made equal to the source electric potential thereof. Field effect transistors M3 and M4 are n-type-channel field effect transistors, have the same impurity concentration in substrate and also in channel doping, are formed in a p-well of the n-type substrate, and the substrate electric potential of each field effect transistor is made equal to the source electric potential thereof. The ratio S=W/L of the channel width W and channel length L of each transistor is such that Sm1=Sm2, and Sm3=Sm4, where Smi denotes the ratio of the channel width W and channel length L of the field effect transistor Mi.

The field effect transistor M1 has a high-concentration n-type gate. The gate electric potential of the transistor M1 is applied by a source-follower circuit including a p-type-channel field effect transistor M5 and resistors R1 and R2. The field effect transistor M2 is of depletion type and has a high-concentration p-type gate, and the gate and source thereof are connected so that the transistor M2 acts as a constant current source. The field effect transistor M3 is of depletion type, has a high-concentration n-type gate. The field effect transistor M4 is of depletion type, has a low-concentration n-type gate, and the gate and source thereof are connected so that the transistor M4 acts as a constant current source.

The same current flows through the pair of field effect transistors M1 and M2. Accordingly, the voltage between the gate and source of the field effect transistor M1 is (VCC·VPN). Further, the same current flows through the pair of field effect transistors M3 and M4. Accordingly, the voltage between the gate and source of the field effect transistor M3 is −VPTAT.

Accordingly, the source electric potential V3 of the field effect transistor M3 is:

$$V3=VPN\cdot R2/R1+\mathrm{VPTAT}(=Vref\text{: reference voltage})$$

The temperature characteristic of V3 can be arbitrarily set by changing the impurity concentrations of the high-concentration n-type gate(s), low-concentration n-type gate (s) and p-type gate(s), or the resistances of the resistors R1 and R2.

Figure 26:
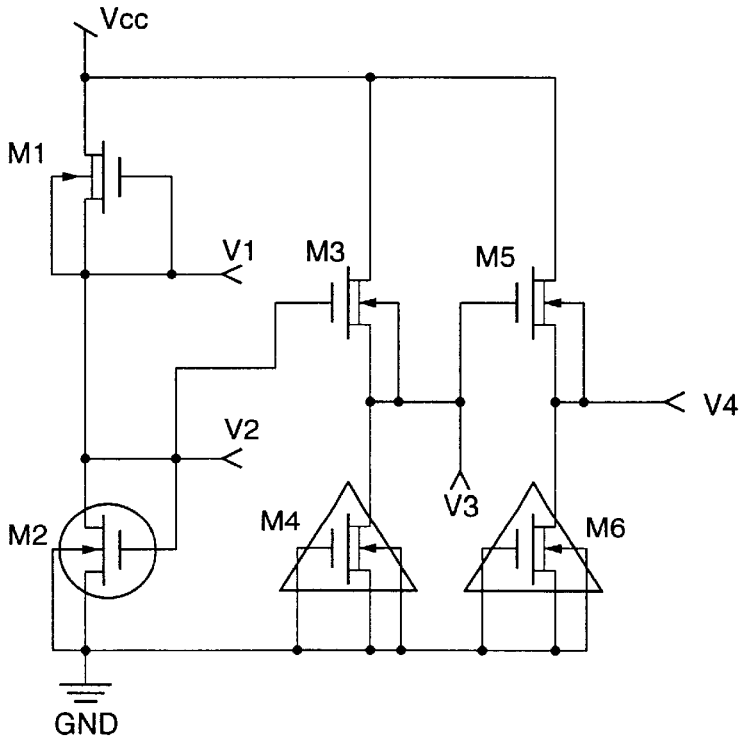
FIG. 26 shows a basic circuit configuration of a fourteenth embodiment of the present invention.

FIG. 26 shows a circuit configuration in a fourteenth embodiment of the present invention.

In FIG. 26, field effect transistors M1, M2, M3, M4, M5 and M6 are all n-type-channel field effect transistors, have the same impurity concentration in substrate and also in channel doping, are formed in a p-well of an n-type substrate, and the substrate electric potential of each field effect transistor is made equal to the source electric potential thereof. The ratio S=W/L of the channel width W and channel length L of each transistor is such that Sm1=Sm2, Sm3=Sm4 and Sm5=Sm6, where Smi denotes the ratio of the channel width W and channel length L of the field effect transistor Mi.

The field effect transistor M1 is of depletion type and has a high-concentration n-type gate, and the gate and source thereof are connected so that the transistor M1 acts as a constant current source. The field effect transistor M2 is of enhancement type and has a high-concentration p-type gate, and the gate and drain thereof are connected. The field effect transistors M3 and M5 are of depletion type, and have high-concentration n-type gates. The field effect transistors M4 and M6 are of depletion type, have low-concentration n-type gates, and, for each transistor, the gate and source thereof are connected so that each of the transistors M4 and M6 acts as a constant current source.

The same current flows through the pair of field effect transistors M1 and M2. Accordingly, the voltage between the gate and source of the field effect transistor M2 is VPN. Further, the same current flows through the pair of field effect transistors M3 and M4. Accordingly, the voltage between the gate and source of the field effect transistor M3 is −VPTAT. Furthermore, the same current flows also through the pair of field effect transistors M5 and M6. Accordingly, the voltage between the gate and source of the field effect transistor M5 is −VPTAT.

Accordingly, the source electric potential V4 of the field effect transistor M5 is:

$$V4=VPN+\mathrm{VPTAT}+\mathrm{VPTAT}(=Vref\text{: reference voltage})$$

The temperature characteristic of V4 can be arbitrarily set by changing the impurity concentrations of the high-concentration n-type gate(s), low-concentration n-type gate (s) and p-type gate(s), or changing the number of stages of the pairs of transistors (M3/M4, M5/M6, . . . ) each of which is a voltage source having a positive temperature coefficient.

Figure 27:
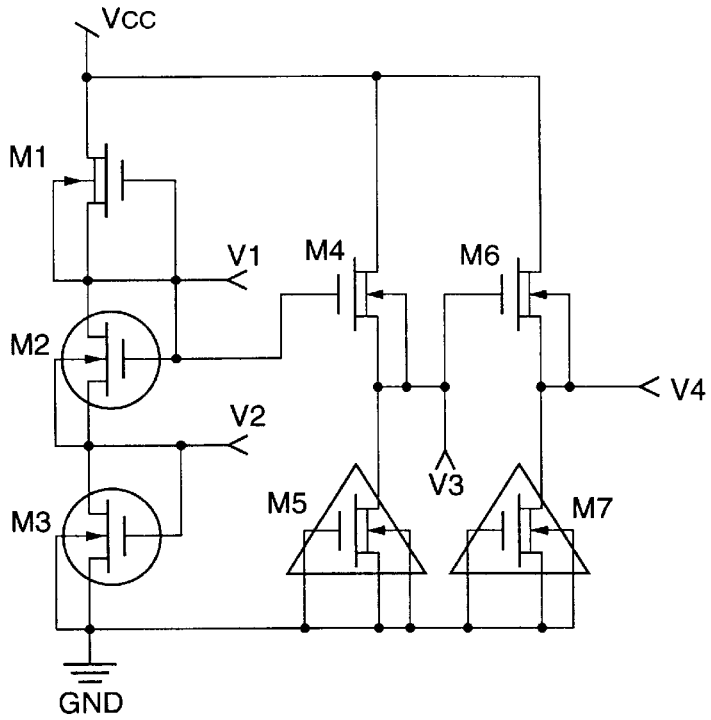
FIG. 27 shows a basic circuit configuration of a fifteenth embodiment of the present invention.

FIG. 27 shows a circuit configuration in a fifteenth embodiment of the present invention.

In FIG. 27, field effect transistors M1, M2, M3, M4, M5, M6 and M7 are all n-type-channel field effect transistors, have the same impurity concentration in substrate and also in channel doping, are formed in a p-well of an n-type substrate, and the substrate electric potential of each field effect transistor is made equal to the source electric potential thereof. The ratio S=W/L of the channel width W and channel length L of each transistor is such that Sm1=Sm2=Sm3, and Sm4=Sm5, where Smi denotes the ratio of the channel width W and channel length L of the field effect transistor Mi.

The field effect transistor M1 is of depletion type and has a high-concentration n-type gate, and the gate and source thereof are connected so that the transistor M1 acts as a constant current source. The field effect transistors M2 and M3 are of enhancement type, have high-concentration p-type gates, and, for each transistor, the gate and drain thereof are connected. The field effect transistors M4 and M6 are of depletion type, and have high-concentration n-type gates. The field effect transistors M5 and M7 are of depletion type, have low-concentration n-type gates, and, for each transistor, the gate and source thereof are connected so that each of the transistors M5 and M7 acts as a constant current source.

The same current flows through the pair of field effect transistors M1 and M2, and, also, the same current flows through the pair of field effect transistors M1 and M3. Accordingly, the voltage between the gate and source of each of the field effect transistors M2 and M3 is VPN. Further, the same current flows through the pair of field effect transistors M4 and M5. Accordingly, the voltage between the gate and source of the field effect transistor M4 is −VPTAT. Furthermore, the same current flows also through the pair of field effect transistors M6 and M7. Accordingly, the voltage between the gate and source of the field effect transistor M6 is −VPTAT.

Accordingly, the source electric potential V4 of the field effect transistor M6 is:

$$V4=VPN+VPN+\mathrm{VPTAT}+\mathrm{VPTAT}(=Vref\text{: reference voltage})$$

The temperature characteristic of V4 can be arbitrarily set by changing the impurity concentrations of the high-concentration n-type gate(s), low-concentration n-type gate (s) and p-type gate(s), or changing the number of stages of the pairs of transistors (M1/M2, M1/M3, . . . ) each of which is a voltage source having a negative temperature coefficient, or changing the number of stages of the pairs of transistors (M4/M5, M6/M7, . . . ) each of which is a voltage source having a positive temperature coefficient.

Figure 28:
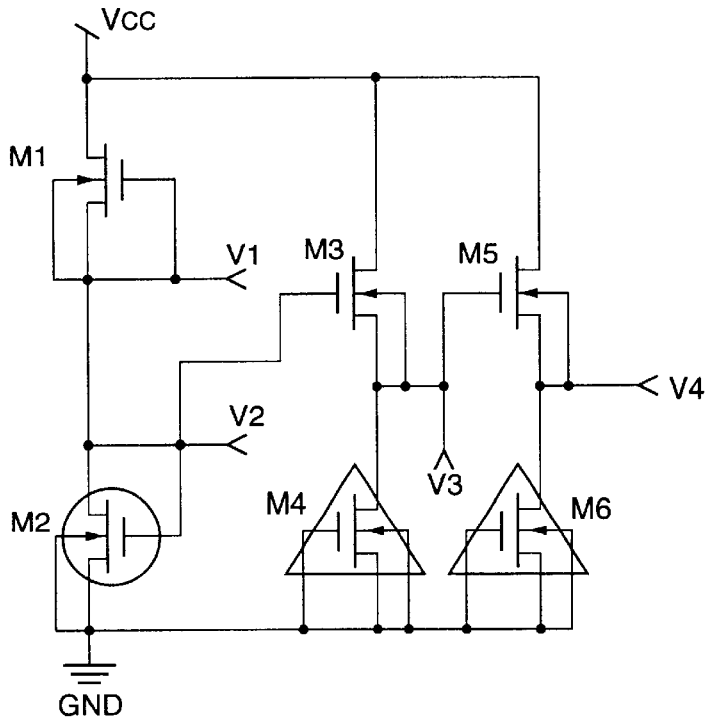
FIG. 28 shows a basic circuit configuration of a sixteenth embodiment of the present invention.

FIG. 28 shows a circuit configuration in a sixteenth embodiment of the present invention.

In FIG. 28, field effect transistors M1, M2, M3, M4, M5 and M6 are all enhancement-type n-type-channel field effect transistors, have the same impurity concentration in substrate, are formed in a p-well of an n-type substrate, and the substrate electric potential of each field effect transistor is made equal to the source electric potential thereof. The ratio S=W/L of the channel width W and channel length L of each transistor is such that Sm1=Sm2, Sm3=Sm4 and Sm5=Sm6, where Smi denotes the ratio of the channel width W and channel length L of the field effect transistor Mi. Further, there is no channel doping in each transistors.

The field effect transistor M1 is of enhancement type, has a high-concentration n-type gate, and the gate and source thereof are connected so that the transistor M1 acts as a constant current source which operates in the weak inversion range or transition range. The field effect transistor M2 is of enhancement type, has a high-concentration p-type gate, and the gate and drain thereof are connected. The field effect transistors M3 and M5 are of enhancement type, and have high-concentration n-type gates. The field effect transistors M4 and M6 are of enhancement type, have low-concentration n-type gates, and, for each transistor, the gate and source thereof are connected so that each of the transistor M5 and M7 acts as a constant current source which operates in the weak inversion range or transition range.

The same current flows through the pair of field effect transistors M1 and M2. Accordingly, the voltage between the gate and source of the field effect transistor M2 is VPN. Further, the same current flows through the pair of field effect transistors M3 and M4. Accordingly, the voltage between the gate and source of the field effect transistor M3 is −VPTAT. Furthermore, the same current flows also through the pair of field effect transistors M5 and M6. Accordingly, the voltage between the gate and source of the field effect transistor M5 is −VPTAT.

Accordingly, the source electric potential V4 of the field effect transistor M5 is:

$$V4=VPN+\mathrm{VPTAT}+\mathrm{VPTAT}(=Vref\text{: reference voltage})$$

The temperature characteristic of V4 can be arbitrarily set by changing the impurity concentrations of the high-concentration n-type gate(s), low-concentration n-type gate (s) and p-type gate(s).

Specific examples of numerical values will now be applied to the sixteenth embodiment. The voltage between gate and source for causing the drain current of 1 nA to flow is determined as the threshold voltage. Then, each of the threshold voltages of the high-concentration n-type field effect transistors M1, M3 and M5 is assumed to be 0.2 V, each of the threshold voltages of the low-concentration n-type field effect transistors M4 and M6 is assumed to be 0.3 V, the S-value which is a changing amount of the voltage between the gate and source required for changing the drain current by one digit is assumed to be 100 mV. Then, the drain current of the field effect transistor M1 of which the gate and source are connected is 10 nA, and the drain current of each of the field effect transistors M4 and M6 of which the gate and source are connected is 1 nA.

Thus, by employing a pair of field effect transistors in the same substrate concentration and having no channel doping, it is possible to improve a pair characteristic and to reduce a current consumption.

The present invention is not limited to the above-described embodiments, and variations and modifications may be made without departing from the scope of the present invention.

The present application is based on Japanese priority applications Nos. 11-372432 and 2000-014330, filed on Dec. 28, 1999 and Jan. 24, 2000, respectively, the entire contents of which are hereby incorporated by reference.

What is claimed is:

1. A voltage generating circuit comprising a plurality of field effect transistors at least partially having gates same in conductivity type but different in impurity concentration.

2. The voltage generating circuit as claimed in claim 1, wherein said gates are different in impurity concentration by not less than one digit.

3. The voltage generating circuit as claimed in claim 2, wherein:

said plurality of field effect transistors comprises first and second field effect transistors having gates same in conductivity type but different in impurity concentration; and the gates of said first and second field effect transistors are connected, and the difference in source voltage between said first and second field effect transistors is output.

4. The voltage generating circuit as claimed in claim 2, wherein:

said plurality of field effect transistors comprises first and second field effect transistors having gates same in conductivity type but different in impurity concentration; and the sources of said first and second field effect transistors are connected, and the difference in gate voltage between said first and second field effect transistors is output.

5. The voltage generating circuit as claimed in claim 2, wherein:

said plurality of field effect transistors comprises first and second field effect transistors having gates same in conductivity type but different in impurity concentration; and the voltage between the gate and source of any one of said first and second field effect transistors is made to be 0 volts, and, also, the voltage between the gate and source of the other one of said first and second field effect transistors is output.

6. The voltage generating circuit as claimed in claim 5, wherein:

said second field effect transistor is an n-type-channel field effect transistor of depletion type, having a high-concentration n-type gate and having the gate and source thereof connected;

said first field effect transistor is an n-type-channel field effect transistor having a low-concentration n-type gate and having the drain thereof connected with the source of said second field effect transistor;

a third n-type-channel field effect transistor and a resistor connected in series are further provided;

a source-follower circuit is provided for applying the gate electric potential of said first field effect transistor by connecting the gate of said first field effect transistor to the connection point between said third field effect transistor and resistor; and the gate electric potential of said first field effect transistor is output from said connection point.

7. The voltage generating circuit as claimed in claim 5, wherein:

said second field effect transistor is an n-type-channel field effect transistor of depletion type, having a high-concentration n-type gate and having the gate and source thereof connected;

said first field effect transistor is an n-type-channel field effect transistor having a low-concentration n-type gate and having the drain thereof connected with the source of said second field effect transistor;

a third n-type-channel field effect transistor, a first resistor and a second resistor connected in series are further provided;

a source-follower circuit is provided for applying the gate electric potential of said first field effect transistor by connecting the gate of said first field effect transistor to the connection point between said third field effect transistor and first resistor; and the electric potential at the connection point between said first and second resistors is output.

8. The voltage generating circuit as claimed in claim 5, wherein:

said second field effect transistor is an n-type-channel field effect transistor of depletion type, having a high-concentration n-type gate and having the gate and source thereof connected;

said first field effect transistor is an n-type-channel field effect transistor having a low-concentration n-type gate and having the drain thereof connected with the source of said second field effect transistor;

a third n-type-channel field effect transistor, a first resistor and a second connected in series are further provided;

a source-follower circuit is provided for applying the gate electric potential of said first field effect transistor by connecting the gate of said first field effect transistor to the connection point between said first and second resistors; and the electric potential at the connection point between said third field effect transistor and first resistor.

9. The voltage generating circuit as claimed in claim 7, further comprising a resistor trimming part by which the resistances of said first and second resistors are adjusted after diffusion and deposition process in a manufacturing stage.

10. The voltage generating circuit as claimed in claim 8, further comprising a resistor trimming part by which the resistances of said first and second resistors are adjusted after diffusion and deposition process in a manufacturing stage.

11. The voltage generating circuit as claimed in claim 6, wherein said first field effect transistor and second field effect transistor comprise p-type-channel field effect transistors.

12. The voltage generating circuit as claimed in claim 7, wherein said first field effect transistor and second field effect transistor comprises p-type-channel field effect transistors.

13. The voltage generating circuit as claimed in claim 8, wherein said first field effect transistor and second field effect transistor comprises p-type-channel field effect transistors.

14. The voltage generating circuit as claimed in claim 2, wherein:

said plurality of field effect transistors comprise first and second field effect transistors having gates same in conductivity type but different in impurity concentration; and said circuit is configured so that the drain currents of said first and second field effect transistors are made equal.

15. A reference voltage source circuit comprising:

a first voltage source circuit comprising a plurality of field effect transistors at least partly having semiconductor gates same in conductivity type but different in impurity concentration and having a positive temperature coefficient; and a second voltage source circuit comprising a plurality of field effect transistors at least partly having semiconductor gates different in conductivity type and having a negative temperature coefficient.

16. The reference voltage source circuit as claimed in claim 15, wherein said first and second voltage source circuits comprise a first, second and third field effect transistors connected in series and at least partially having semiconductor gates different in conductivity type or impurity concentration.

17. The reference voltage source circuit as claimed in claim 16, wherein:

said first field effect transistor comprises a depletion-type n-type-channel field effect transistor having a high-concentration n-type gate and having the gate and source thereof connected;

said second field effect transistor comprises an n-type-channel field effect transistor having a low-concentration n-type gate;

said third field effect transistor comprises an enhancement-type n-type-channel field effect transistor having a p-type gate and having the gate and drain thereof connected;

a source-follower circuit is provided for applying the gate electric potential of said second field effect transistor; and the gate voltage of said second field effect transistor is output as a reference voltage.

18. The reference voltage source circuit as claimed in claim 16, wherein:

said first field effect transistor comprises an enhancement-type p-type-channel field effect transistor having an n-type gate and having the gate and drain thereof connected;

said second field effect transistor comprises a p-type-channel field effect transistor having a low-concentration p-type gate;

said third field effect transistor comprises a depletion-type p-type-channel field effect transistor having a high-concentration p-type gate and having the gate and source thereof connected;

a source-follower circuit is provided for applying the gate electric potential of said second field effect transistor; and the gate voltage of said second field effect transistor is output as a reference voltage.

19. The reference voltage source circuit as claimed in claim 15, wherein said first and second voltage source circuits comprise a first, second, third and fourth field effect transistors at least partially having semiconductor gates different in conductivity type or impurity concentration.

20. The reference voltage source circuit as claimed in claim 19, wherein:

said first field effect transistor comprises a depletion-type n-type-channel field effect transistor having an n-type gate and having the gate and source thereof connected;

said second field effect transistor comprises an n-type-channel field effect transistor having a p-type gate;

said first and second field effect transistors are connected in series;

a source-follower circuit is provided for applying the gate electric potential of said second field effect transistor;

said third field effect transistor comprises an n-type-channel field effect transistor having a high-concentration n-type gate and having the gate electric potential thereof applied by said source-follower circuit;

said fourth field effect transistor comprises an n-type-channel field effect transistor having a low-concentration n-type gate;

a differential amplifier is configured to have said third and fourth field effect transistors as input transistors thereof; and the gate electric potential of said fourth field effect transistor is output as a reference voltage.

21. The reference voltage source circuit as claimed in claim 19, wherein:

said first field effect transistor comprises a p-type-channel field effect transistor having an n-type gate;

said second field effect transistor comprises a depletion-type p-type-channel field effect transistor having a p-type gate and having the gate and source thereof connected;

said first and second field effect transistors are connected in series;

a source-follower circuit is provided for applying the gate electric potential of said second field effect transistor;

said third field effect transistor comprises an n-type-channel field effect transistor having a high-concentration n-type gate and having the gate electric potential thereof applied by said source-follower circuit;

said fourth field effect transistor comprises an n-type-channel field effect transistor having a low-concentration n-type gate;

a differential amplifier is configured to have said third and fourth field effect transistors as input transistors thereof; and the gate electric potential of said fourth field effect transistor is output as a reference voltage.

22. The reference voltage source circuit as claimed in claim 19, wherein:

said first field effect transistor comprises a depletion-type n-type-channel field effect transistor having an n-type gate and having the gate and source thereof connected;

said second field effect transistor comprises an n-type-channel field effect transistor having a p-type gate;

said first and second field effect transistors are connected in series;

a source-follower circuit is provided for applying the gate electric potential of said second field effect transistor;

said third field effect transistor comprises an n-type-channel field effect transistor having a high-concentration n-type gate and having the gate electric potential thereof applied by said source-follower circuit;

said fourth field effect transistor comprises an n-type-channel field effect transistor having a low-concentration n-type gate and having the gate and source thereof made to be at a ground electric potential;

said third and fourth field effect transistors are connected in series; and a reference voltage is output from the connection point between said third and fourth field effect transistors.

23. The reference voltage source circuit as claimed in claim 19, wherein:

said first field effect transistor comprises a p-type-channel field effect transistor having an n-type gate;

said second field effect transistor comprises a depletion-type p-type-channel field effect transistor having a p-type gate and having the gate and source thereof connected;

said first and second field effect transistors are connected in series;

a source-follower circuit is provided for applying the gate electric potential of said first field effect transistor;

said third field effect transistor comprises a p-type-channel field effect transistor having a low-concentration n-type gate and having the gate electric potential thereof applied by said source-follower circuit;

said fourth field effect transistor comprises a p-type-channel field effect transistor having a high-concentration n-type gate and having the gate and drain thereof connected;

said third and fourth field effect transistors are connected in series; and a reference voltage is output from the connection point between said third and fourth field effect transistors.

24. The reference voltage source circuit as claimed in claim 19, wherein:

said first field effect transistor comprises a depletion-type n-type-channel field effect transistor having an n-type gate and having the gate and source thereof connected;

said second field effect transistor comprises a n-type-channel field effect transistor having a p-type gate;

said first and second field effect transistors are connected in series;

a source-follower circuit is provided for applying the gate electric potential of said second field effect transistor;

said third field effect transistor comprises a depletion-type p-type-channel field effect transistor having a high-concentration p-type gate and having the gate and source thereof connected;

said fourth field effect transistor comprises a p-type-channel field effect transistor having a low-concentration p-type gate and having the gate electric potential thereof applied by said source-follower circuit;

said third and fourth field effect transistors are connected in series; and a reference voltage is output from the connection point between said third and fourth field effect transistors.

25. The reference voltage source circuit as claimed in claim 19, wherein:

said first field effect transistor comprises a p-type-channel field effect transistor having an n-type gate;

said second field effect transistor comprises a depletion-type p-type-channel field effect transistor having a p-type gate and having the gate and source thereof connected;

said first and second field effect transistors are connected in series;

a source-follower circuit is provided for applying the gate electric potential of said first field effect transistor;

said third field effect transistor comprises a depletion-type n-type-channel field effect transistor having a high-concentration n-type gate and having the gate electric potential thereof applied by said source-follower circuit;

said fourth field effect transistor comprises an n-type-channel field effect transistor having a low-concentration n-type gate and having the gate and source thereof connected;

said third and fourth field effect transistors are connected in series; and a reference voltage is output from the connection point between said third and fourth field effect transistors.

26. The reference voltage source circuit as claimed in claim 15, wherein at least any one of said first and second voltage source circuits is employed a plurality of times.

27. The reference voltage source circuit as claimed in claim 26, wherein:

said second voltage source circuit comprises a first field effect transistor comprising a depletion-type n-type-channel field effect transistor having an n-type gate and having the gate and source thereof connected, and a second field effect transistor comprising an enhancement-type n-type-channel field effect transistor having a p-type gate and having the gate and drain thereof connected, said first and second field effect transistors being connected in series;

a first one of said first voltage source circuit comprises a third field effect transistor comprising an n-type-channel field effect transistor having a high-concentration n-type gate and having the gate electric potential thereof applied by the drain voltage of said second field effect transistor and a fourth field effect transistor comprising a depletion-type n-type-channel field effect transistor having a low-concentration n-type gate and having the gate and source thereof made to be a ground electric potential, said third and fourth field effect transistors being connected in series;

a second one of said first voltage source circuit comprises a fifth field effect transistor having the gate electric potential thereof applied by the voltage at the connection point between said third and fourth field effect transistors and a sixth field effect transistor comprising a depletion-type n-type-channel field effect transistor having a low-concentration n-type gate and having the gate and source thereof made to be the ground electric potential, said fifth and sixth field effect transistors being connected in series; and a reference voltage is output from the connection point between said fifth and sixth field effect transistors.

28. The reference voltage source circuit as claimed in claim 26, wherein:

said second voltage source circuit comprises a first field effect transistor comprising a depletion-type n-type-channel field effect transistor having an n-type gate and having the gate and source thereof connected, and second and third field effect transistors each comprising an enhancement-type n-type-channel field effect transistor having a p-type gate and having the gate and drain thereof connected, said first, second and third field effect transistors being connected in series;

a first one of said first voltage source circuit comprises a fourth field effect transistor comprising an n-type-channel field effect transistor having a high-concentration n-type gate and a fifth field effect transistor comprising a depletion-type n-type-channel field effect transistor having a low-concentration n-type gate and having the gate and source thereof made to be a ground electric potential, said fourth and fifth field effect transistors being connected in series;

a second one of said first voltage source circuit comprises a sixth field effect transistor comprising an n-type channel field effect transistor having a high-concentration n-type gate and having the gate electric potential thereof applied by the voltage at the connection point between said fourth and fifth field effect transistors and a seventh field effect transistor comprising a depletion-type n-type-channel field effect transistor having a low-concentration n-type gate and having the gate and source thereof made to be the ground electric potential, said sixth and seventh field effect transistors being connected in series; and a reference voltage is output from the connection point between said sixth and seventh field effect transistors.

29. The reference voltage source circuit as claimed in claim 15, wherein field effect transistors of said first and second voltage source circuits at least partially have gates different in conductivity type or impurity concentration, and do not employ channel doping.

30. The reference voltage source circuit as claimed in claim 29, wherein:

said second voltage source circuit comprises a first field effect transistor comprising an enhancement-type n-type-channel field effect transistor having an n-type gate and having the gate and source thereof connected, and a second field effect transistor comprising an enhancement-type n-type-channel field effect transistor having a p-type gate and having the gate and drain thereof connected, said first and second field effect transistors being connected in series;

a first one of said first voltage source circuit comprises a third field effect transistor comprising an n-type-channel field effect transistor having a high-concentration n-type gate and a fourth field effect transistor comprising an enhancement-type n-type-channel field effect transistor having a low-concentration n-type gate and having the gate and source thereof made to be a ground electric potential, said third and fourth field effect transistors being connected in series;

a second one of said first voltage source circuit comprises a fifth field effect transistor comprising an n-type-channel field effect transistor having a high-concentration n-type gate and having the gate electric potential thereof applied by the voltage at the connection point between said third and fourth field effect transistors and a sixth field effect transistor comprising an enhancement-type n-type-channel field effect transistor having a low-concentration n-type gate and having the gate and source thereof made to be the ground electric potential, said fifth and sixth field effect transistors being connected in series; and a reference voltage is output from the connection point between said fifth and sixth field effect transistors.

31. The reference voltage source circuit as claimed in claim 16, wherein:

the drain currents of said first, second and third field effect transistors are made to be equal.

32. The reference voltage source circuit as claimed in claim 19, wherein:

the drain currents of said first and second field effect transistors are made to be equal; and the drain currents of said third and fourth field effect transistors are made to be equal.

33. The reference voltage source circuit as claimed in claim 26, wherein:

the drain currents of the field effect transistors of each first voltage source having the semiconductor gate same in conductivity type but different in impurity concentration are made to be equal; and the drain currents of the field effect transistors of each second voltage source having the semiconductor gate different in conductivity type are made to be equal.

34. The reference voltage source circuit as claimed in claim 29, wherein:

the drain currents of the field effect transistors of each first voltage source having the semiconductor gate same in conductivity type but different in impurity concentration are made to be equal; and the drain currents of the field effect transistors of each second voltage source having the semiconductor gate different in conductivity type are made to be equal.

35. The voltage generating circuit as claimed in claim 1, wherein each gate comprises single-crystal silicon.

36. The voltage generating circuit as claimed in claim 1, wherein each gate comprises polycrystal silicon.

37. The voltage generating circuit as claimed in claim 36, wherein approximately not less than 98% of the dangling bonds of said polycrystal silicon are terminated.

38. The voltage generating circuit as claimed in claim 1, wherein each gate comprises polycrystal $Si_xGe_{1-x}$.

39. The voltage generating circuit as claimed in claim 38, wherein the composition ratio of $Si_xGe_{1-x}$ is such that approximately $0.01<X<0.5$.

40. The voltage generating circuit as claimed in claim 15, wherein each gate comprises single-crystal silicon.

41. The voltage generating circuit as claimed in claim 15, wherein each gate comprises polycrystal silicon.

42. The voltage generating circuit as claimed in claim 41, wherein approximately not less than 98% of the dangling bonds of said polycrystal silicon are terminated by hydrogen or fluorine.

43. The voltage generating circuit as claimed in claim 15, wherein each gate comprises polycrystal $Si_xGe_{1-x}$.

44. The voltage generating circuit as claimed in claim 43, wherein the composition ratio of $Si_xGe_{1-x}$ is such that approximately $0.01<X<0.5$.

* * * * *